US006448488B1

(12) United States Patent
Ekhaus et al.

(10) Patent No.: US 6,448,488 B1
(45) Date of Patent: Sep. 10, 2002

(54) MEASUREMENT AND PROCESSING OF STRINGED ACOUSTIC INSTRUMENT SIGNALS

(75) Inventors: Ira Ekhaus, Arlington; Lawrence Fishman, Winchester, both of MA (US)

(73) Assignee: Fishman Transducers, Inc., Wilmington, MA (US)

( * ) Notice: Subject to any disclaimer, the term of this patent is extended or adjusted under 35 U.S.C. 154(b) by 0 days.

(21) Appl. No.: 09/889,444

(22) PCT Filed: Jan. 12, 2000

(86) PCT No.: PCT/US00/00836

§ 371 (c)(1),
(2), (4) Date: Jul. 12, 2001

(87) PCT Pub. No.: WO00/42599

PCT Pub. Date: Jul. 20, 2000

Related U.S. Application Data

(60) Provisional application No. 60/116,095, filed on Jan. 15, 1999.

(51) Int. Cl.[7] ..... G10H 1/06; G10H 1/12

(52) U.S. Cl. ..... 84/735; 84/622; 84/659; 84/661; 84/736; 84/DIG. 9

(58) Field of Search ..... 84/723–726, 730–731, 84/735–738, DIG. 9, 622–626, 659–661

(56) References Cited

U.S. PATENT DOCUMENTS

| | | | | |
|---|---|---|---|---|
| 5,591,931 A | * | 1/1997 | Dame | 84/736 |
| 6,000,833 A | * | 12/1999 | Gershenfeld et al. | 84/600 |
| 6,011,213 A | * | 1/2000 | Duruoz | 84/DIG. 9 |
| 6,222,110 B1 | * | 4/2001 | Curtis et al. | 84/736 |

* cited by examiner

*Primary Examiner*—Marlon T. Fletcher
(74) *Attorney, Agent, or Firm*—Chadbourne & Parke, LLP

(57) ABSTRACT

A system and a method of measuring, decomposing, processing and uniquely recombining forces and vibrations acting on stringed musical instruments (SMI). The system utilizes a digital signal processor and reproduces the musical sound characteristics of an acoustic instrument into high fidelity electrical signals for amplification, processing and/or filtering and reproduction of musical sounds by uniquely exploiting, through measurements and subsequent signal processing, the vector nature of string excitation forces (SEF) and body vibrations of stringed musical instruments. A signal processing system of the current invention also utilizes a plurality of sensors, each responsive to at least one of force, displacement, velocity or acceleration indicative of the vibrational energy of the strings, to produce a sensor signal vector, which is then processed and transformed by a plurality of re-creation filters into a transformed signal vector, and then resynthesized into an output signal. The resynthesized output signal be a microphone output signal, may have acoustic characteristics of another SMI or possess acoustic characteristics of a "theoretical" SMI.

39 Claims, 12 Drawing Sheets

MEASUREMENT AND PROCESSING OF STRINGED ACOUSTIC INSTRUMENT SIGNALS

Applicant hereby claims the benefit of the earlier filing date of Provisional Patent Application No. 60/116,095 filed on Jan. 15, 1999 entitled, "Measurement and Processing of Stringed Acoustic Instrument Signals" and now pending.

FIELD OF THE INVENTION

The invention relates to the measurement of stringed musical instrument vibrations and subsequent processing of these signals. More particularly, this invention relates to the reproduction of musical sounds characteristic of acoustic instruments into high fidelity electrical signals for amplification and reproduction of musical sounds, by uniquely exploiting, through measurements and subsequent signal processing the vector nature of string excitation forces (SEF) and body vibrations of stringed musical instruments (SMI's).

BACKGROUND OF THE INVENTION

Methods of amplifying (for purposes of both performance or recording) stringed musical instruments (SMI) employ sensors that measure acoustic pressure (i.e. microphones), force (i.e. piezo) and displacement (strain gauge, hall effect, laser), velocity (coil pickups) and acceleration (accelerometers). A common expectation in using techniques that combine sensors other than microphones is that the sensors will be mounted semi-permanently in a manner that mitigates sensor placement issues. While these sensors are obviously integral to electric guitars, players of acoustic SMI's have grown to rely on the convenience and consistency of "plugging in". In fact, acceptance of this technique has grown to the point that approximately 20% of acoustic guitars sold in the US have factory installed embedded sensor (ES) systems. We will refer to these sensors, along with any subsequent processing (analog or digital), as an embedded sensor technique in contrast to a solely microphonic approach.

Although microphones are by definition the only objective, quantitative means to directly capture the true acoustic sound of a SMI, microphone measurements of SMI sound are affected by placement and, in amplified scenarios, there is the potential for unstable feedback among microphone, instrument and the amplifier. To avoid problems of placement and feedback, embedded sensors such as piezo force transducers are often placed under the saddle of an acoustic guitar or on the bridge of violins and/or cellos. The quality of this amplified sound (typically taken from either bridge or sound hole based signals) has heretofore fallen short of the true acoustical signal measured from a microphone.

In striving to improve the reproduction of acoustic SMI characteristics using embedded sensor techniques, prior efforts have focused primarily on either of two distinct mechanisms involved in SMI sound generation. The first SMI characteristic is that the string force applied to the witness point (the point of contact between saddle and string) can be resolved into a plurality (up to 3) of significant components. Prior art teaches methods to isolate, suppress or advantageously combine string excitation force (SEF) components by improved sensor means. These efforts include U.S. Pat. No. 3,453,920 issued to Scherer, ("Scherer1") and U.S. Pat. No. 4,903,566 issued to Mcclish, ("Mcclish").

Lazarus U.S. Pat. No. 3,624,264 issued to Lazarus, ("Lazarus") aptly compares the motions of the bridge block of a guitar to those of a ship at sea; With the convention that the contact point of the guitar's low E string is port, and the high E string starboard, the three acoustically significant modes of bridge block vibration (BBV) are pitch, roll and heave, Through proper positioning of vibration sensors about the bridge, works such as Lazarus or its commercial descendent Trance-Audio's ("Acoustic Lens") http://www.tranceaudio.com/manuals/lens.pdf and http://www.tranceaudio.com/lens.html), claim to effectively capture the tonal qualities of the SMI by indirectly measuring the multi-directional nature of SEF's through measurements of BBV's on the surface of the SMI. As shown below, while these sensors are responsive to the three vibration modes (pitch, roll and heave), the sound is primarily affected by repositioning the pickup on the body of the guitar and the ability to manipulate the sound is significantly constrained. Moreover, discussion below will describe the advantages of the present invention over limitations of sensor based component nulling techniques as represented by Scherer and McClish.

A second distinct SMI characteristic results from the structural features such as a resonant cavity that provide frequency responses unique to different classes of instruments. Embedded sensor approaches where sensors are directly responsive to the string excitation do not directly measure the characteristic colorations of an acoustic SMI. U.S. Pat. No. 4,819,537 issued to Hayes et al., ("Hayes") teaches a post-processing methods that can reintroduce the characteristic Helmholtz resonance of a particular SMI. Other ES sensor approaches, such as Lazarus and Trance-Audio, claim to be uniquely responsive to vibrational modes due to and representative of these characteristic resonances, but are limited to the sound that can be measured on the surface of the guitar. In contrast the present invention provides a capability and theoretical framework for more flexible manipulation of embedded sensor (ES) signals.

Moreover, a body of work (fairly represented by "Plucked string models: from (Karplus-Strong) algorithm to digital waveguides and beyond", by M. Karjalainen and V. Vlimki and T. Tolonen Vol 22, number 3, Computer Music Journal, 1998, or http://www.acoustics.hut.fi/~vpv/publications/cmj98.htm) has developed synthesis techniques that combine multiple polarization string models with models of guitar body resonances.

These works contain a sophisticated theoretical basis for synthesis of a guitar signal, but in contrast to the present invention, do not teach the processing of embedded sensor signals that can re-create the sound characteristics of a particular SMI.

SUMMARY OF THE INVENTION

For analysis purposes, SMI vibrations are decomposed into modes that can be generally defined as having monopole, dipole or even quadrapole physical interpretations of distinct surface plate modal patterns, for example as taught by fletcher (("The Physics of Musical Instruments") by Neville H. Fletcher and Thomas D. Rossing (Chapter 9) Springer Verlag ISBN: 0387983740). The representation of the SMI state by physical modes $\Psi_i(r)$ is advantageous in the study of SMI acoustics, but another modal representation that is particularly suited to the simulation and re-creation of SMI acoustic characteristics (an objective of the present invention) involves "PRISM" modes. PRISM modes will be introduced by way of a description of a standard physical mode model of SMI sound generating mechanisms.

The distribution of surface state of a SMI (e.g. a guitar) can be described via a summation of modes:

$$\alpha(r, w) = \sum_i \lambda_i(w)\Psi_i(r), \tag{1}$$

where $\Psi_i(r)$ is the $i^{th}$ mode (r coordinates) linearly weighted and summed by the complex modal amplitude $$\lambda_i(w)=a_i(w)e^{j\Phi_i(W)} \tag{2}$$

($a_i(w)$, $\Phi_i(w)$, magnitude and phase), to form the total state (displacement and or velocity) $\alpha(r, w)$ as a function of frequency w and position r. The surface states $\alpha(r, w)$ are then weighted and summed by the pointwise (with respect to r) acoustic transfer function $C(r, w|R)$ to form the acoustic pressure $$S^{mic}(w)=\int C(r,w|R)\alpha(r,w)dr \tag{3}$$

seen at a point R as a function of frequency w.

Equation 3 defines the relation between physical state $\alpha(r,w)$ and the output $S^{mic}(w)$, but more importantly for the present invention is the relation between the output and the particular physical excitation of this system which is the SEF vector $$F = \begin{bmatrix} V \\ T \\ L \end{bmatrix}, \tag{4}$$

whose vertical, transverse and longitudinal force components (all implicit functions of frequency) excite the heave, roll and pitch motions of the bridge block, which in turn excite unique combinations of the physical modes of an SMI $\Psi_i(r)$. These combinations of physical modes can be regrouped into "PRISM modes", which serve the role of a transfer function between the vertical, transverse and longitudinal force components of SEFs and their respective contributions to the acoustic pressure $S^{mic}(w)$ at point R.

Viewing the combination of the SMI's physical response and the measurement system (microphone or other arbitrary linear device), $S^q$ as a cascade of linear systems, and dropping the explicit notational dependence of ω, we can recast the system model of equation 3 as a matrix product with input F, system model G and a generalized (one or more signals) output $S^q$ as $$S^q=G^{q\leftarrow F}F, \tag{5}$$

with individual elements defined by $$\begin{bmatrix} S_1 \\ S_2 \\ \vdots \\ S_N \end{bmatrix} = \begin{bmatrix} g_{V,S_1} & g_{T,S_1} & g_{L,S_1} \\ g_{V,S_2} & g_{T,S_2} & g_{L,S_2} \\ \vdots & \vdots & \vdots \\ g_{V,S_N} & g_{T,S_N} & g_{L,S_N} \end{bmatrix} \begin{bmatrix} V \\ T \\ L \end{bmatrix}. \tag{6}$$

where $g_{\eta},S_i(w)$ is defined as the transfer function between a particular SEF component η (η⊂[V,T,L]), and the measurement $S_i$. Equation 5, in its most general interpretation, relates the SEF force F, to a set of arbitrary measurements proportional to the forces applied to and vibrations on the SMI's body. The superscript $(\ )^q$ denotes a generic measurement scenario, employing a microphone or a set of embedded sensor, and is used in the discussion of general principals involving the present invention.

Consider the specific vector measurement of forces and vibrations from a set of sensors referenced to body points (bp) on the bridge block of an SMI, that responds to the SEF F in accordance with $$S^{bp} = \left(\left[S_1^{bp}\ S_2^{bp}\ S_3^{bp}\right]\right)^T \tag{7}$$

$$= G_i^{bp\leftarrow F}F. \tag{8}$$

Without development at this point, we define a "synthetic" signal model where, contrary to the convention of the physical measurement systems of equation 5, the system transfer function uses an arbitrary set of ES measurements $S^q$ (a generalization of $S^{bp}$) as an input to the system modeled by $G^{mic\leftarrow q}$ (as yet undetermined) to yield the output signal $$S^{mic'}=G^{mic\leftarrow q}S^q, \tag{9}$$

where the modified superscript of $S^{mic'}$ denotes the goal of synthesizing the original microphone phone signal $S^{mic}$.

Equation 9 has the same form as the SMI signal model (equation 5) with inputs $S^{bp}$ and output $S^{mic'}$.

It will be readily seen that other signal data/re-creation pairs are achievable, for example:

1. Accelerometer to microphone:
   acceleration measurements on the face or bridge block of the SMI are processed to recreate the SMI's microphone output—"the sound" of the instrument.
2. Force measurement device to microphone:
   force measurements on the bridge saddle interface of the SMI, are processed to recreate the SMI's microphone output—"the sound" of the instrument.
3. Force measurement device to accelerometers:
   force measurements on the bridge saddle interface of the SMI, are processed to recreate the accelerations on the SMI's face.
4. Accelerometers to force measurement device
   acceleration measurements on the face or bridge of the SMI, are processed to recreate the forces at the contact point R saddle interface of the SMI.

A key innovation of the present invention is the consistent means by which the full information content of the SEF components F is uniquely preserved throughout an arbitrary measurement, $S^q$ and subsequent processing via $G^{mic'\leftarrow q}$ to enable all of the embodiments described above.

In a preferred embodiment of the invention, a plurality of sensors are mounted on one or more common mechanical bases onto a MI and processing this vector signal set in a systematic manner. The analog signals from these sensors are processed in either analog or digital (with prior conversion) formats by methodologies described herein to faithfully reproduce acoustic characteristics of the MI as could be measured by a microphone.

In SMI's such as guitars, SEF's are applied to the instrument's face through a bridge and/or bridge/saddle combination where the string termination point is placed well within the bridge block. In other SMI's such as jazz guitars and violins, strings are stretched over a bridge and/or bridge/saddle combination and terminate at a separate tailpiece. In this case the present invention defines a means to measure a SEF that more faithfully models the forces acting on the SMI.

The benefits of the present invention stem from the basic ability presented herein to decompose a set of sensor signals into their constitutive components and with a high degree flexibility, accurately and efficiently recombine these components. Preferred embodiments of the present invention provide advantages that include the ability to faithfully resynthesize the SMI sound measured by a microphone with a set of ES sensors, which can be installed in a repeatable fashion to provide a microphone sound without the cost or complications of a microphone. Hence, the present invention defines and implements a means to re-create $S^q$ through the set of re-creation filters $G^{mic' \leftarrow q}$ whose factored components include the SMI sound characteristic $G^{mic \leftarrow F}$ and the correction for measurement coloration $G^{q \leftarrow F\dagger}$. The pseudo-inverse operation $(\ )^{554}$ and its operation on the measurement coloration $G^{q \leftarrow F\dagger}$ will be explained below.

the ability to reapportion the longitudinal,vertical and transverse components of the SMI output. The phrase "longitudinal component of the SMI" meaning the component of the SMI output due to the longitudinal component of SEF F.

the ability to null specific SEF components (longitudinal, vertical or transverse) of the SMI output. For example it is well known that the longitudinal components of a vibrating string include harmonics that are twice the fundamental frequency of vibration. Removing these components without spectral filtering can provide an advantage in pitch detection application where these longitudinal modes are an unwanted signal characteristic.

the ability to isolate individual components of the SMI output due to longitudinal, vertical or transverse SEF components, for further nonlinear processing.

the ability to manipulate a two sensor system responsive to a plurality of SEF components as a subset of the full processing technique.

the ability to specify a new system response $G^{mic' \leftarrow q}$ that includes an arbitrary defined SMI characteristic $G^{mic \leftarrow F}$ "grafted" onto the correction for measurement coloration $G^{q \leftarrow F\dagger}$.

An object of this invention is to provide a method of measurement and subsequent processing of musical instrument signals to faithfully reproduce existing acoustic musical instruments.

It is another object to provide a method of processing signals to systematically reproduce characteristics of "theoretical" acoustic instruments with arbitrary relation to existing SMI's.

It is another object to provide a method of processing signals to systematically reproduce the total characteristics of the SMI/microphone combination by parametrically altering the system characteristics. For example, combinations of Prism modes can be interpreted as corresponding to distinct physical modes of vibration (e.g. monopole, dipole) whose sound radiation characteristics have physically predetermined variations due to the microphone's distance to the SMI and it's relative angle to the normal to the guitar's surface. Parametrically linking the phase and amplitude of specific Prism modes to a microphone's relative position, affords a means to programmatically control the position of a "virtual" microphone.

It is another object to provide a method of processing signals to systematically null specific component(s) of the SMI microphone output, said component(s) being due to longitudinal, vertical and/or transverse SEF components.

It is another object to provide a method of processing signals to reapportion the longitudinal, vertical or transverse SEF components of the SMI output.

It is another object of this invention to provide an improved means of measuring $S^q$.

It is another object of this invention to determine the elements of the system model $G^{mic' \leftarrow q}$ which do not require specific knowledge of the underlying acoustic signal model $G^{micf}$.

It is another object of this invention to process $S^q$ via equation 9 to generate signals $S^{mic'}$ that approximate a reference signal such as the microphone signal $S^{mic}$.

DETAILED DESCRIPTION OF A PREFERRED EMBODIMENT OF THE INVENTION

Figure 1:
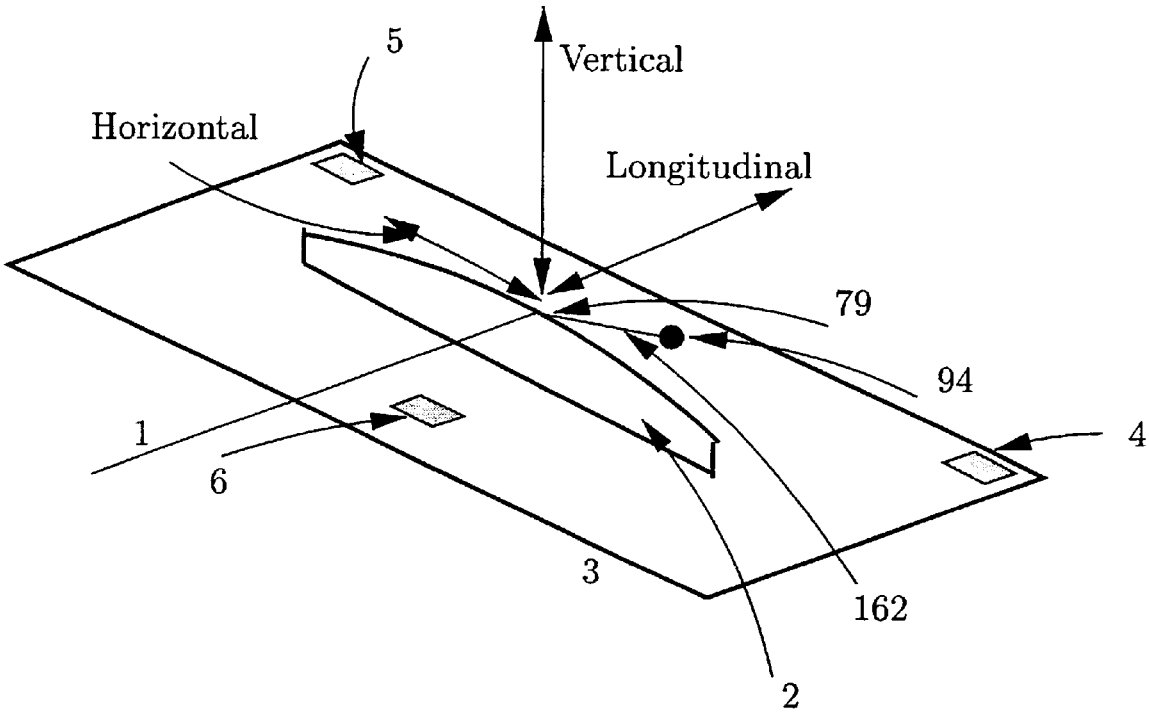
FIG. 1 represents a bridge and saddle arrangement along with the locations of various vibrations sensors and the string.

FIG. 1 shows a typical bridge and saddle arrangement. A string 1 is mounted over a saddle piece 2 that fits into the bridge 3 of a typical stringed musical instrument(SMI), by example a guitar. Three orthogonal components of force are shown. The vertical, longitudinal and horizontal components are applied at the contact point 79 by the string 1. The string 1 stretches over the saddle and is mounted at the anchor point 94. The string tailpiece portion 162 acts as a restraining spring against the tension of the string. The figure shows a typical arrangement of body point sensors 4, 5, 6, respectively the first, second and third, that measure the vibrations of the bridge block at three distinct positions. Three sensors 4, 5, 6, are acceleration sensors, where three sensors is the minimum number required to indirectly measure the full information content of the string excitation forces (SEF) F through bridge block acceleration.

Figure 2:
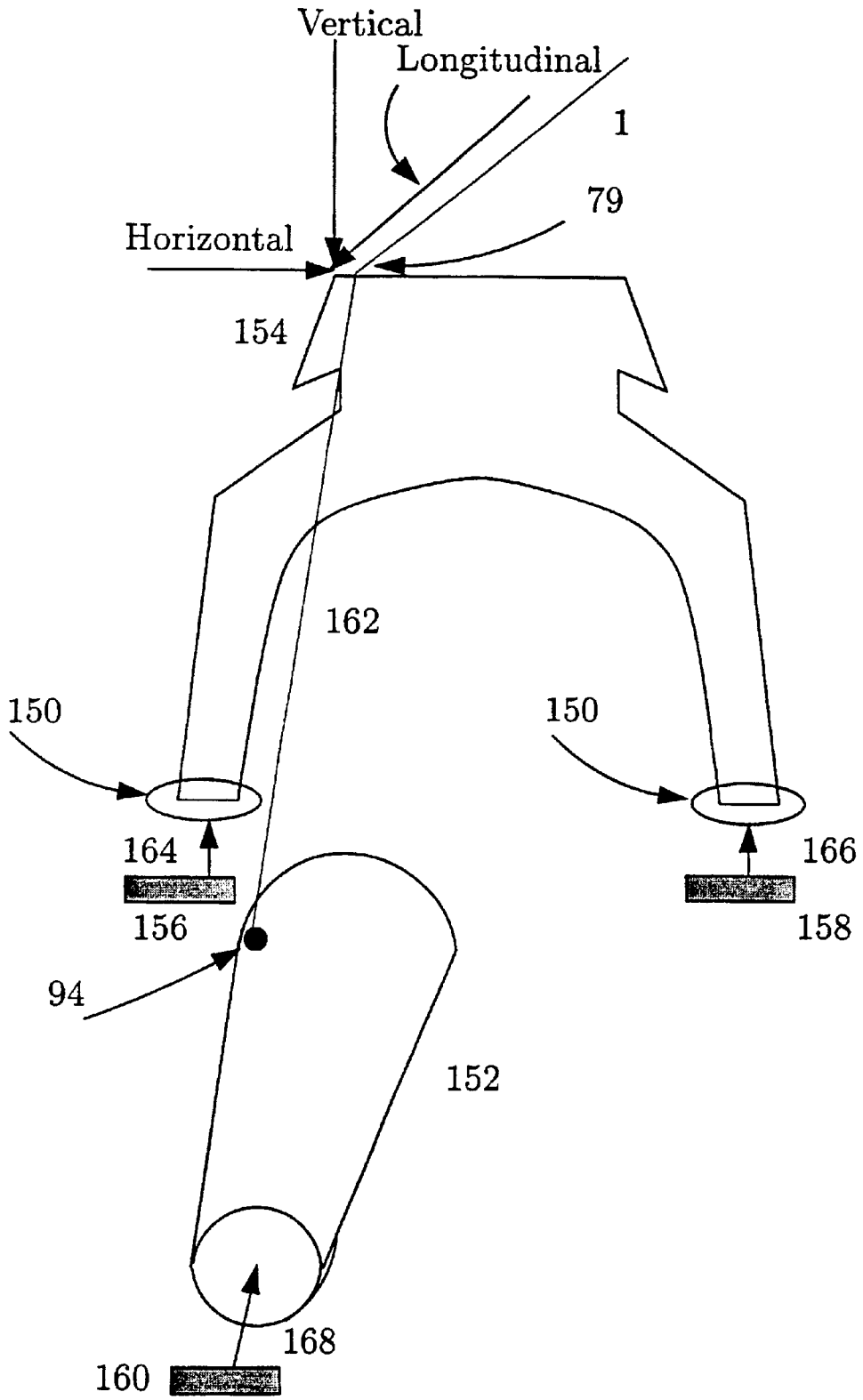
FIG. 2 represents a typical tailpiece/bridge arrangement used in violin, cellos and jazz-style guitars along with the locations of various vibrations sensors and the string.

FIG. 2 shows a typical tailpiece/bridge arrangement used in violin, cellos and jazz-style guitars. The string 1 is mounted over a bridge 154 of a SMI and mounted to a tailpiece 152. Three orthogonal components of force imposed by the string are shown; The vertical, longitudinal and horizontal components at the contact point 79. The string tailpiece portion 162 acts as a restraining spring against the tension of the string, and the tailpiece 152 resolves into a mount-point 160 with a bearing force 168. These forces are resolved into the body of the SMI at three bearing points 156, 158 and 160 corresponding to the forces on the left bearing 164, right bearing 166 and tailpiece mount point 168 respectively. Force sensing material 150 is placed at each of these bearing points to measure forces applied to the body of the SMI by the string 1 through the bridge and tailpiece combination.

Figure 3:
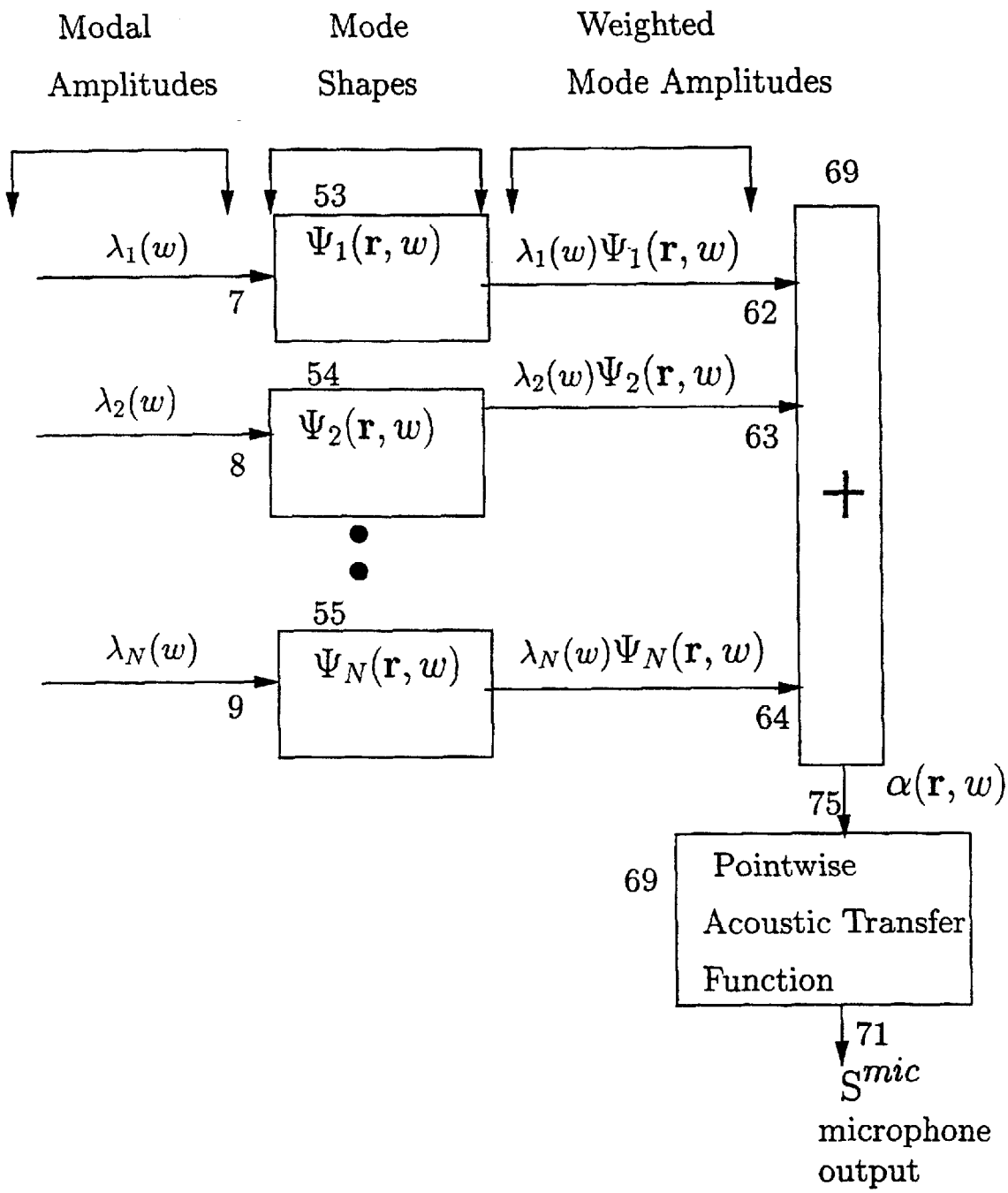
FIG. 3 schematically represents the SMI system model of equation 5.

FIG. 3 shows a model of the sound generating mechanism of an SMI. A set of modal amplitudes $\lambda_i(w)$ (i=0 . . . N, where N is the number of modes) (7, 8, 9) weight the modal shapes $\Psi_i(r)$ (53, 54, 55) to form the weighted modal shapes $\lambda_i(w)\ \Psi_i(r)$ (62, 63, 64) that are summed at the summer 69 to form the total SMI state $\alpha(r, w)$. These modal amplitudes would be developed by playing the SMI or otherwise exciting the bridge. Equation 15 below shows how the modal amplitudes are related to the SEF F. The total SMI state $\alpha(r, w)$ 75 is passed through a pointwise acoustic transfer function $C(r,w|R)$ 69, yielding the final output $S^{mic}(w)$ 71.

Figure 4:
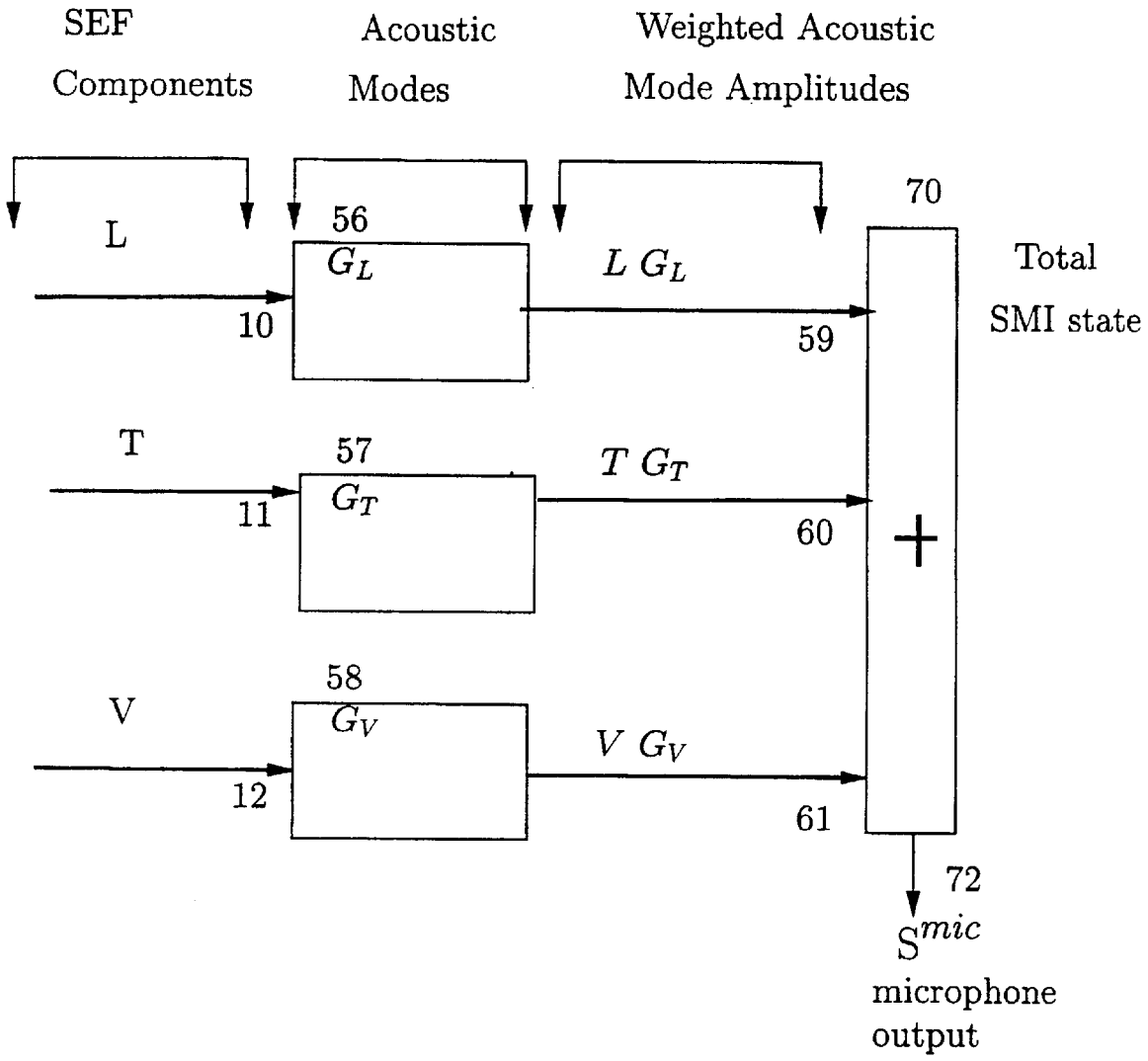
FIG. 4 schematically represents an SMI system model using an alternate modal representation closely related to the SEF components F.

FIG. 4 shows a model of an alternate modal representation of the sound generating mechanism of an SMI. Three orthogonal force components [V, T, L] (12, 11, 10) are used as inputs to three distinct systems $[G_V, G_T, G_L]$ (58, 57, 56) each responsive to and transforming its respective force component to an acoustic pressure. The respective outputs of each of these sub-systems $[VG_V, TG_T, LG_L]$ (61, 60, 59) are summed at the summer 70 to form the microphone output $S^{mic}$ 72.

Figure 5:
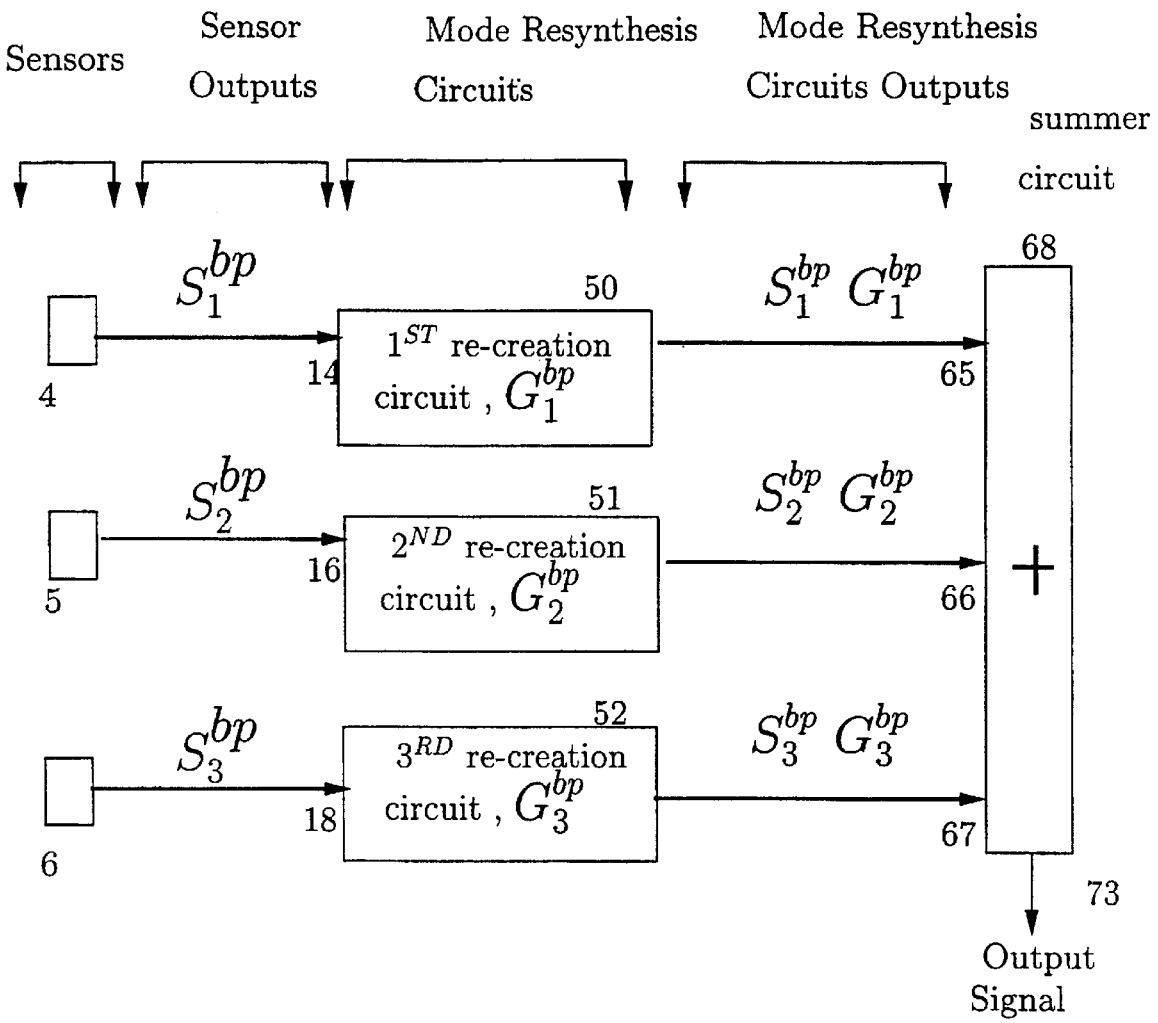
FIG. 5 schematically represents a resynthesis system model.

FIG. 5 shows a re-creation system model (comprised of a bank of re-creation filters) that closely parallels the alternate modal representation for SMI sound generating mechanisms. The three body point (bp) sensors (4, 5, 6) generate output signals $$S_i^{bp}(w)$$

(14, 16, 18) that are used as inputs to three distinct filters $$G_i^{bp\leftarrow F}$$

(50, 51, 52) to generate three distinct outputs $$S_i^{bp\leftarrow F}G_i^{bp}$$

(65, 66, 67) which are summed in the summing circuit 68 to form a resynthesis signal $S^{mic'}$ 73.

Figure 6:
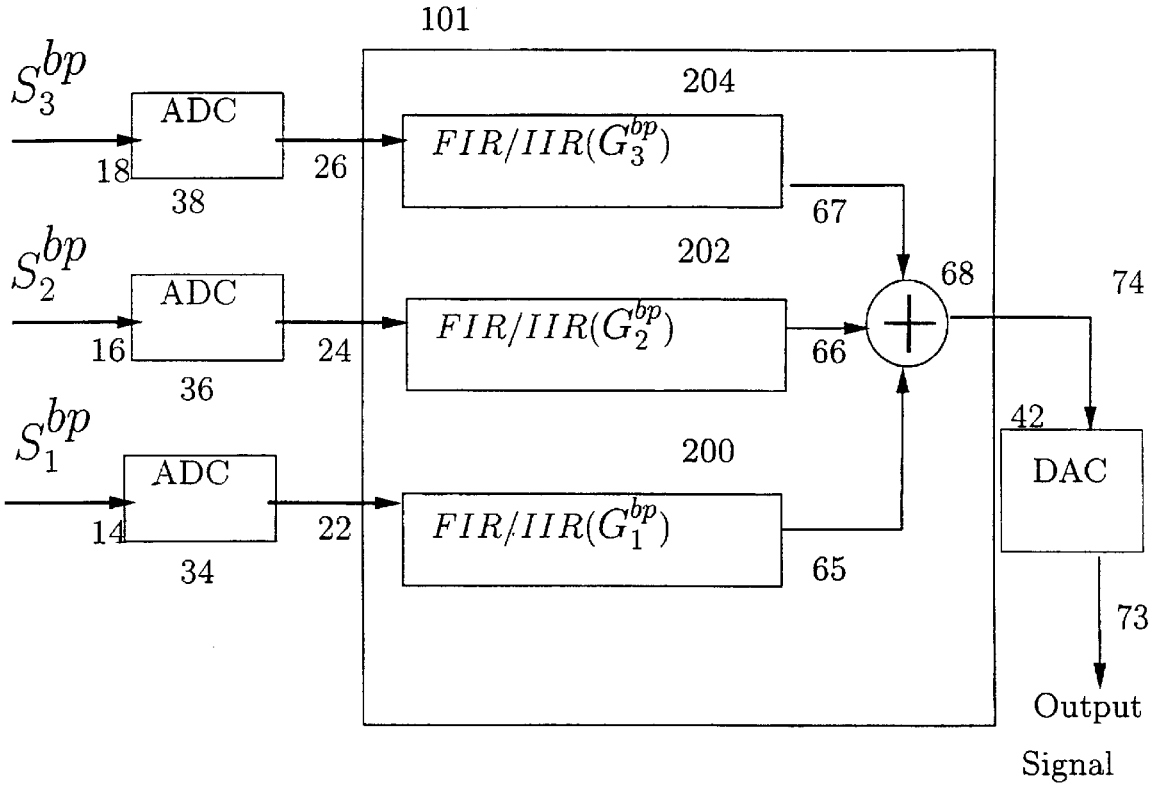
FIG. 6 schematically represents a typical DSP implementation of the resynthesis system model.

FIG. 6 represents a typical digital signal processor (DSP) implementation of the resynthesis system model. Each of the sensor outputs $$S_i^{bp}$$

(14, 16, 18) is digitized with an analog digital converter (ADC) (34, 36, 38), the resulting signals input to a signal processor 101. Each digitized signal (22, 24, 26) is input to its respective filter subroutine $$FIR/IIR(G_i^{bp})$$

(200, 202, 204) that approximates $$G_i^{bp}(w)$$

of FIG. 5 (50, 51, 52). These filters are implemented with either FIR (finite impulse response), IIR (infinite impulse response) structures or a parallel combination thereof (see "Digital Signal Processing") by Oppenheim and Schaefer, Prentice Hall 1983). The implementation of the present invention assumes a system designer familiar with the standard tradeoffs inherent in implementing IIR or FIR filters, as the specific design requirements of the filters depend on the instrument that is being characterized.

The outputs of each filter (65, 66, 67) are passed to the summer circuit 68 and the resulting sum 74 is passed to a digital analog converter (DAC) 42 to provide an analog output signal 73.

Figure 7:
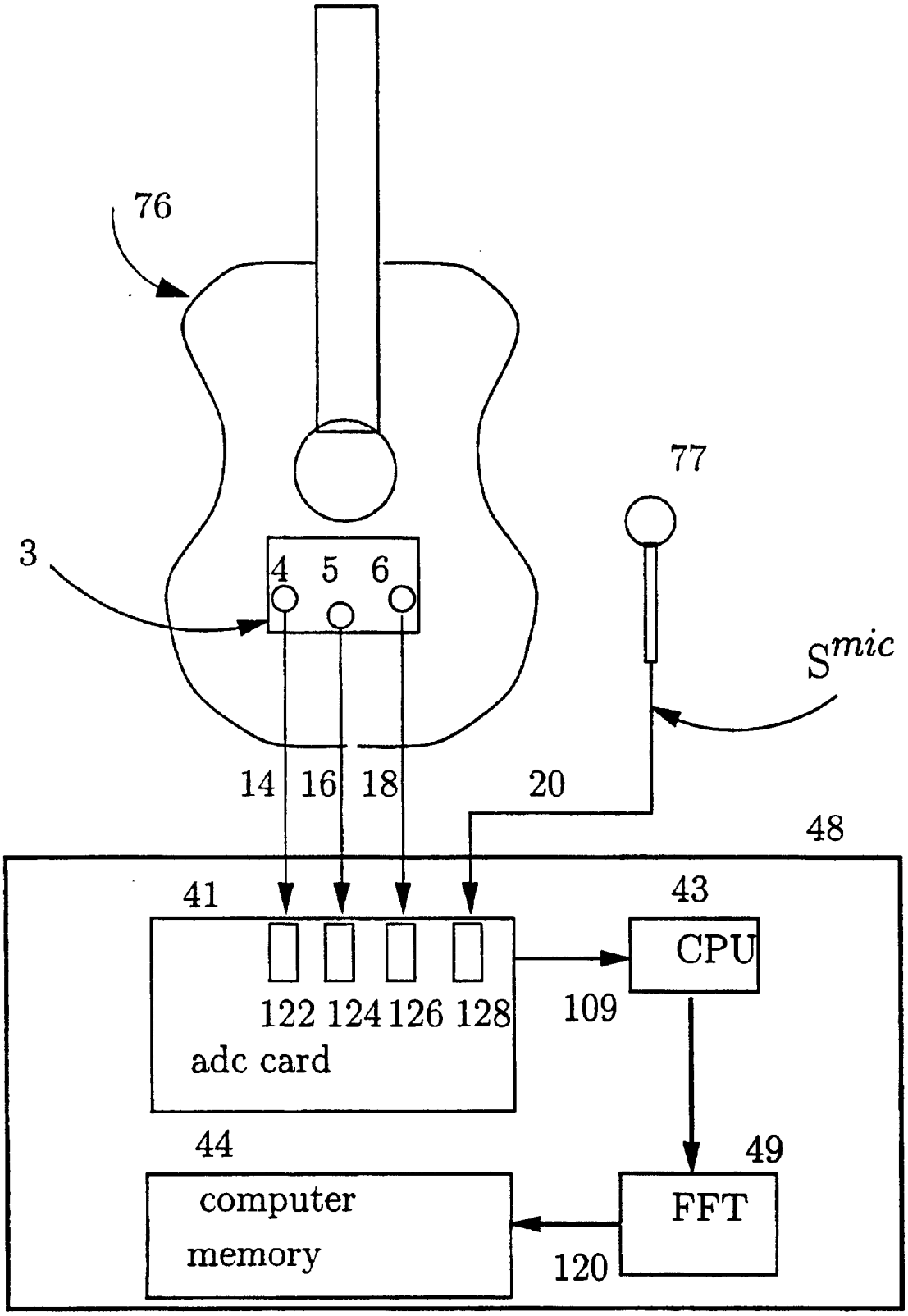
FIG. 7 shows an experimental setup involving 3 accelerometers and 1 microphone.

FIG. 7 shows a calibration measurement configuration for taking the data described in equation 30 for an SMI 76 (a guitar is shown). The sensors (4, 5, 6) which are accelerometers in a preferred embodiment, are mounted on the bridge plate 3 and generate the output signals $$S_i^{bp}$$

(14, 16, 18). A microphone 77 is placed at a specific point R in order to measure the acoustic pressure from the guitar and output the signal $S^{mic}$. The output signals (14, 16, 18) ($S^{bp}$ as a group) and $S^{mic}$ 20 are connected to the input channels (122, 124, 126, 128) of a multiple channel ADC (analog digital converter ) 41 which is housed inside a PC 48. The digitized signals (100, 102, 104, 106) shown in FIG. 8 form a group 109 of signals that are available for display, storage and analysis. This signal group 109 is passed along to the CPU 43 and Fourier transformed in the FFT software module FFT 49, to form the group of spectral outputs 120 which are saved in computer memory 44 for further analysis. These spectral outputs are analogous to the traces (110, 112, 114, 116) of FIG. 9.

Figure 8:
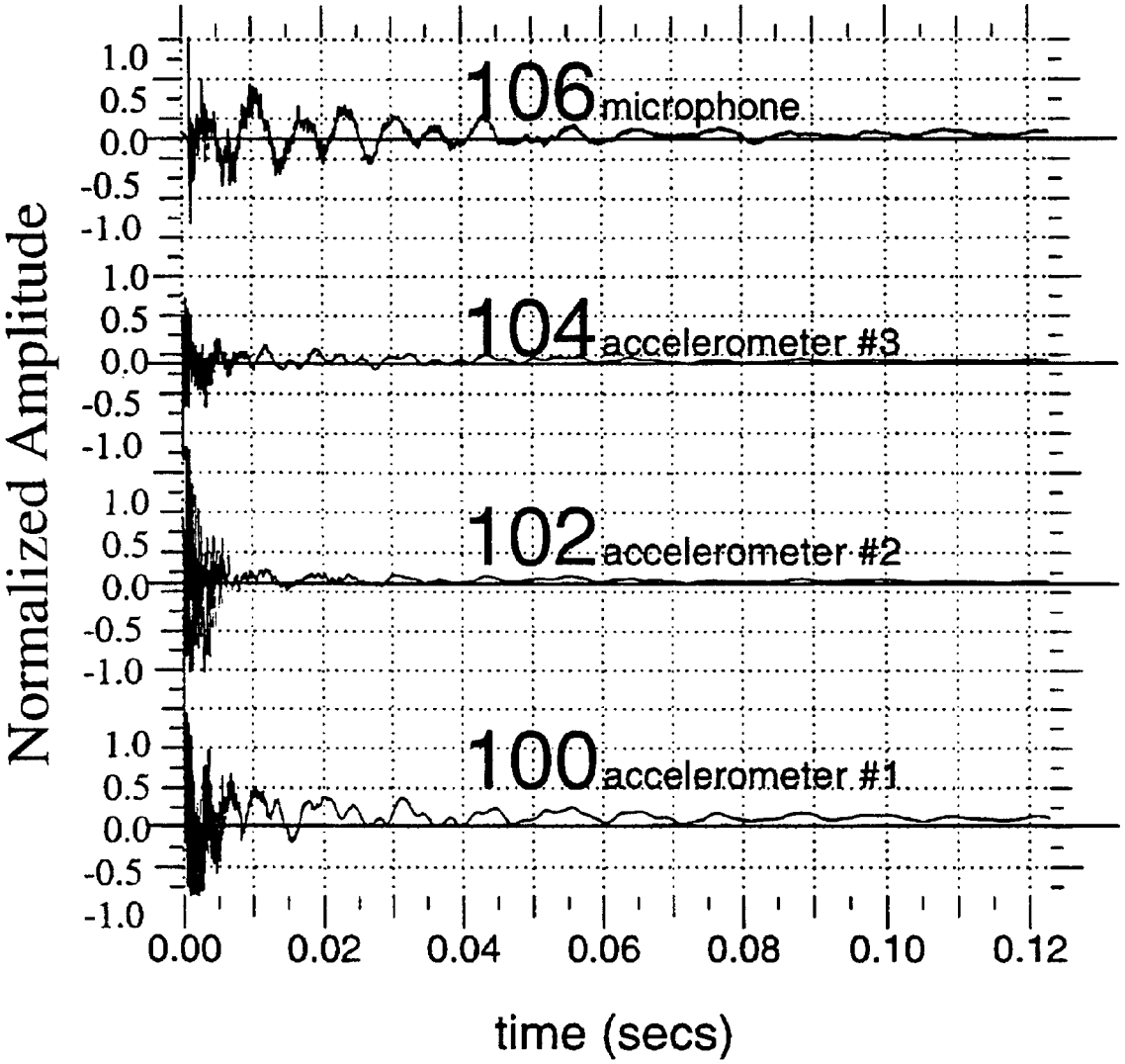
FIG. 8 is a plot of four time recordings, 3 accelerometers and 1 microphone.

FIG. 8 shows a set of amplitude vs time plots for signals (100, 102, 104, 106) corresponding to the outputs from three sensors (4, 5, 6) and a microphone 20 as the signal group 109 for a calibration measurement performed according to FIG. 7.

Figure 9:
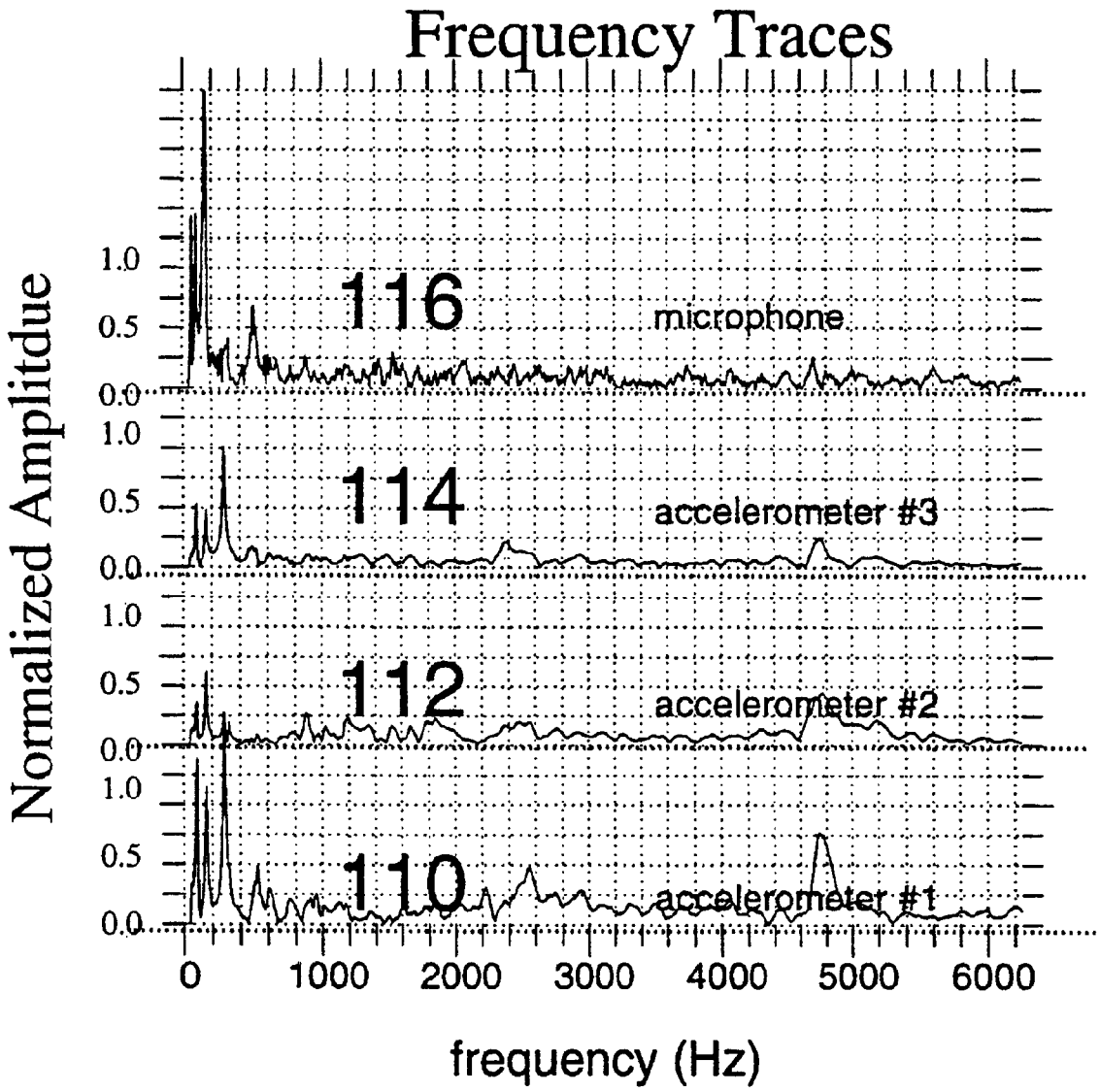
FIG. 9 is a plot of four time recordings, 3 accelerometers and 1 microphone.

FIG. 9 shows a set of amplitude vs frequency plots, corresponding to the three accelerometers spectra and microphone spectrum (110, 112, 114 and 116 respectively) for a calibration setup according to FIG. 7.

Figure 10:
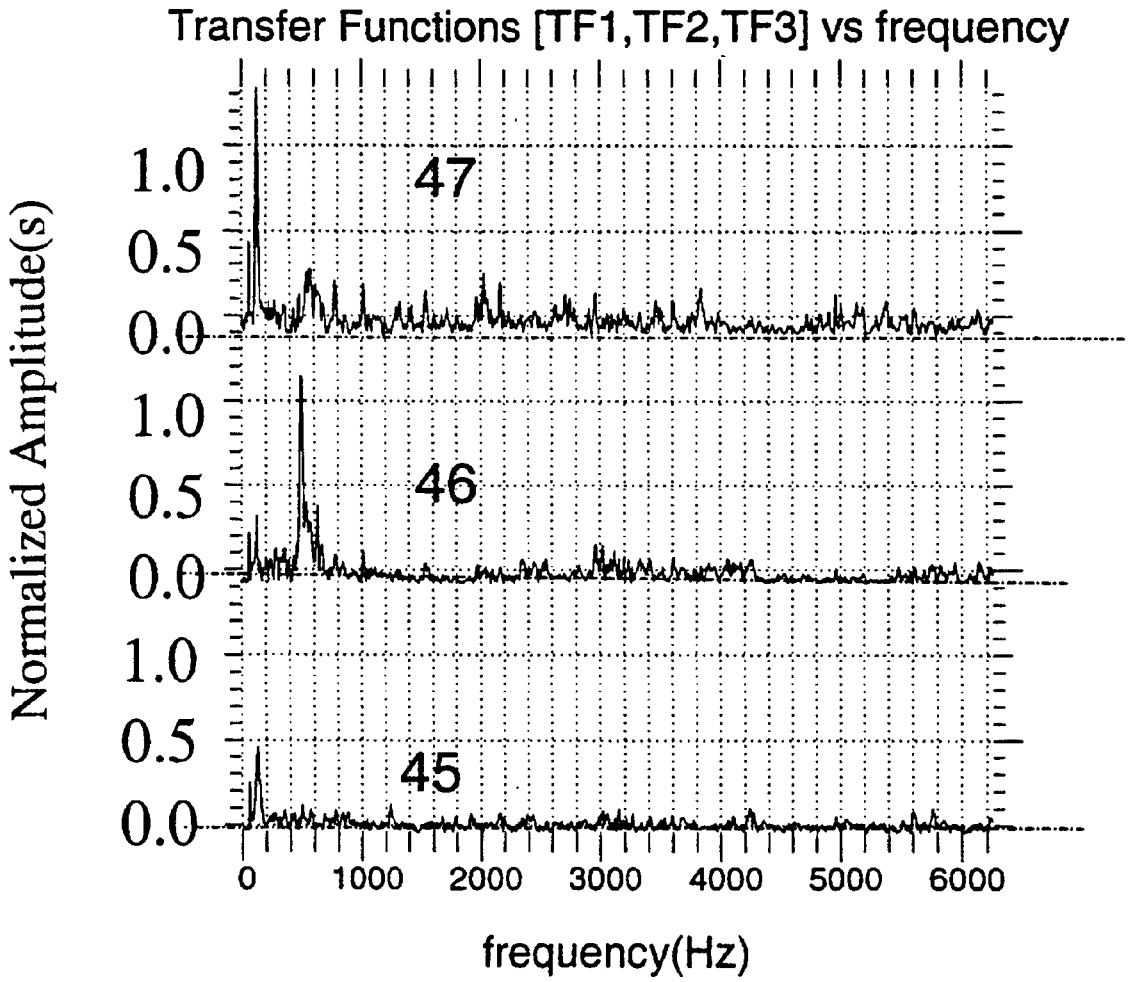
FIG. 10 is a stacked magnitude plot of the vector transfer function $G^{mic \leftarrow bp}$ vs frequency defined by equation 32 for a mike/accelerometer data set.

FIG. 10 shows a set of transfer function 45, 46, 47 traces that correspond to filter subroutine $$(FIR/IIR(G_i^{bp})\ i = 0 \ldots 3)$$

(200, 202, 204) defined by the inversion process of equation 32. The inversion process (described below) casts the accelerometers as the input and microphone as output in a multiple-input/single-out linear system that can be solved through Singular Value Decomposition techniques. The accelerometer spectra 110, 112, 114 and microphone spectrum 116 are the inputs to this inversion process.

Figure 11:
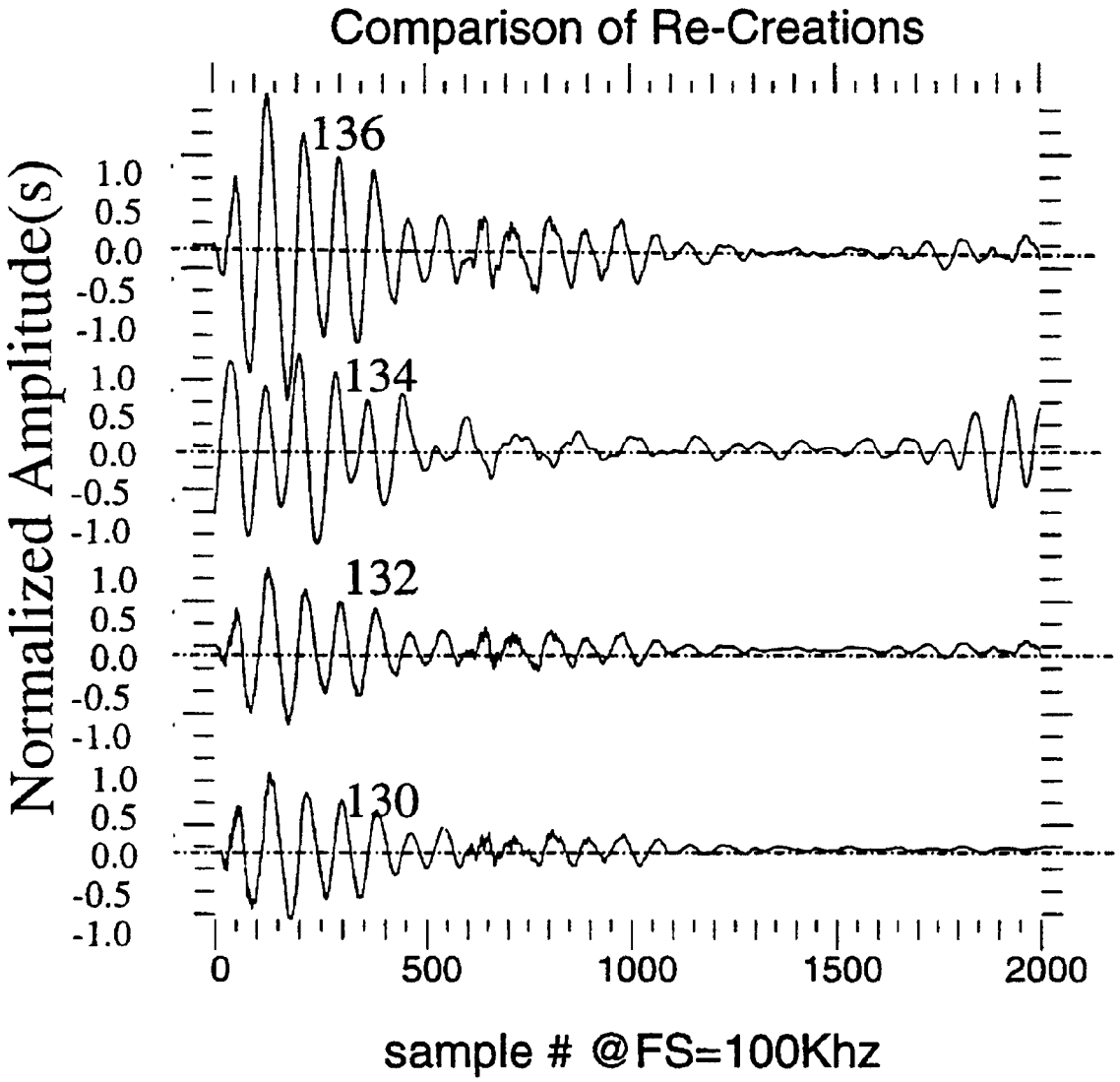
FIG. 11 is a comparison plot of the re-synthesized signal and the microphone signal for a mike/accelerometer data set.

FIG. 11 shows a set of plots comparing the original microphone signal 130 from a calibration measurement configuration conforming to FIG. 7, with various re-creations (132, 132, 134, 136). The four traces share a horizontal axis comprised of time measured in sample number, and each trace has its own respective vertical axis of normalized amplitude.

Re-creation 132 trace is a resynthesis based on an FIR implementation of the transfer functions 45, 46, 47 of FIG. 10. Re-creation 134 trace is a resynthesis based on an 'sparse' FIR implementation of the transfer functions 45, 46, 47 of FIG. 10. A sparse FIR is defined as being comprised of a set of the primary peaks of the transfer functions. Re-creation 136 trace is a resynthesis based on a bandlimited (frequencies less than 1 Khz) FIR implementation of the transfer functions 45, 46, 47.

Figure 12:
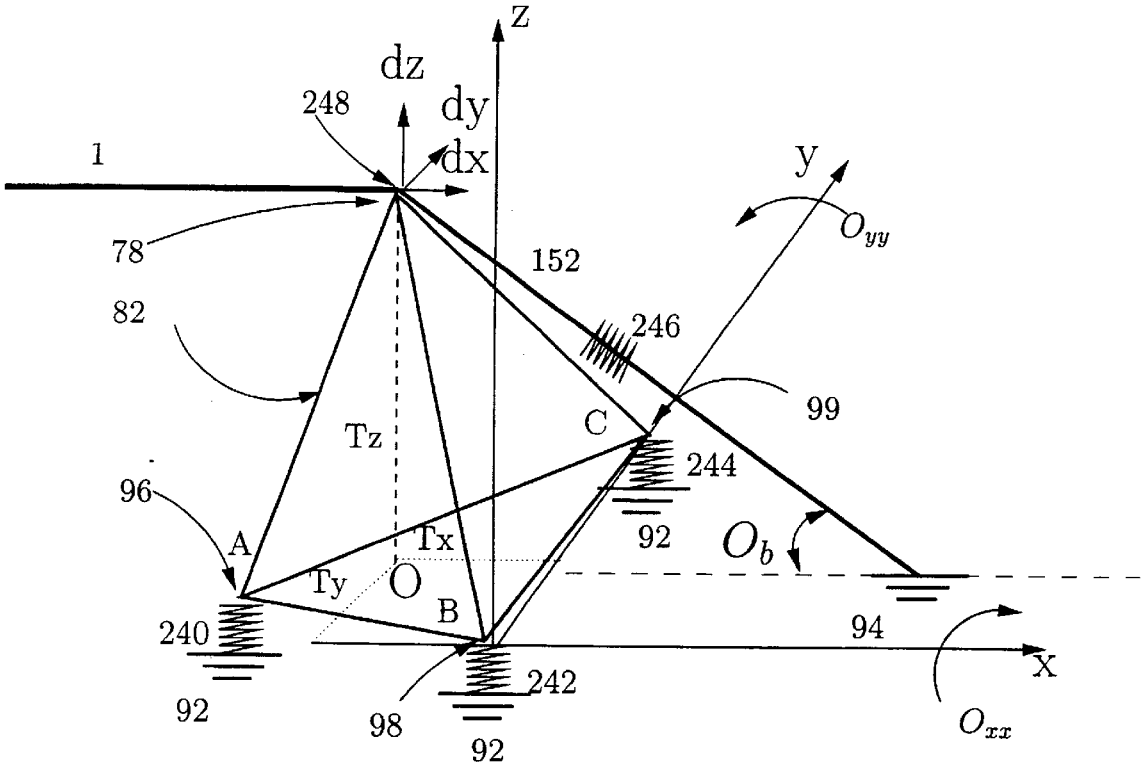
FIG. 12 represents a new saddle configuration optimized for measuring SEF forces.

FIG. 12 shows a three point mounting arrangement (a PRISM mount) that allows for a specific sensing means. A string 1 is mounted over the apex 248 of a mount 82 making contact at the witness/contact point 78, and anchored at 94. The string tailpiece portion 152 is modeled as a spring 246 with constant $K_s$ and break angle $O_b$ to the xy plane. A perpendicular dropped from the apex 248 to the bottom of the mount at point O, provides the geometric quantities $T_x$, $T_y$, $T_z$ to derive the quantities in matrix K (equation 71 below).

The PRISM mount 82 is supported by a set of force sensors (240, 242, 244) that are modeled as springs with spring constants ($K_a$, $K_b$, $K_c$) located at measurement points (96, 98, 99) which are practicably close to the three vertices A, B, C. Slight motions of the prism mount (deflection dz and deflections dx, dy which are derived from rotation $O_{xx}$, $O_{yy}$ about x, y respectively) impart deflections to the force sensors anchored at their bases 92. The known and advantageously designed geometry of the mount and sensor arrangements provides a means to determine the individual components of force that the string imparts to the prism mount 82.

DETAILED DESCRIPTION OF THE THEORY OF THE INVENTION a. The Mathematical Model of the Acoustic SMI As a linear system, the SMI system characterization that yields $S^{mic}$ can be expressed as a complex weighted sum of vectors, all terms implicitly dependent on frequency. In the context of the present invention, we combine the modal response $\Psi_i(r)$ with the pointwise acoustic response C(r, w|R) of equation 3 to yield an expression for the acoustic pressure at a point (microphone) as a matrix product amenable to standard linear algebra manipulations.

First, we take the expression for the acoustic response of an SMI and expand out the SMI surface state α(r, w)

$$S^{mic}(w) = \int C(r, w \mid R)\alpha(r, w)dr \tag{10}$$

$$= \int C(r, w \mid R)\sum_i \lambda_i(w)\Psi_i(r)dr. \tag{11}$$

Then we combine the pointwise acoustic transfer function C(r, w|R) with the mode shapes $\Psi_i(r)$, to define the acoustic response as a complex weighted sum, $$S^{mic}(w) = \sum_i \lambda_i(w)\int C(r, w \mid R)\Psi_i(r)dr \tag{12}$$

$$= \sum_i \lambda_i(w)\Phi_i \tag{13}$$

where $\Phi_i$ now represent acoustic modes, the acoustic response as seen by a microphone at point R due to the ith mode $i^{th}$ mode $\Psi_i(r)$. Now, we recast equation 13 as the matrix product, $$S^{mic}(w) = [\Phi_1\ \Phi_2\ \ldots\ \Phi_N]\begin{bmatrix}\lambda_1(w)\\ \lambda_2(w)\\ \vdots\\ \lambda_N(w)\end{bmatrix}, \tag{14}$$

or more compactly as $$S^{mic}=\Phi\lambda \tag{15}$$

where the values of the modal amplitude λ are determined by the physical inputs to the SMI system whose state is represented by the acoustic modes Φ. As a linear system, the relation between the modal amplitudes of an SMI undergoing vibration, and the three components of the SEF F, can be posed as the matrix product $$\begin{bmatrix}\lambda_1(w)\\ \lambda_2(w)\\ \vdots\\ \lambda_N(w)\end{bmatrix}, = \begin{bmatrix}R_{V,\lambda_1(w)} & R_{T,\lambda_1(w)} & R_{L,\lambda_1(w)}\\ R_{V,\lambda_2(w)} & R_{T,\lambda_2(w)} & R_{L,\lambda_2(w)}\\ \vdots & \vdots & \vdots\\ R_{V,\lambda_N(w)} & R_{T,\lambda_N(w)} & R_{L,\lambda_N(w)}\end{bmatrix}\begin{bmatrix}V\\ T\\ L\end{bmatrix}. \tag{16}$$

or more compactly as $$\lambda=RF. \tag{17}$$

This merely states that F through the response matrix R, maps to a specific SMI physical state defined by its modal amplitudes λ Now using equation 15, the acoustic pressure can be cast as the matrix product $$S^{mic}=\Phi RF \tag{18}$$

with dimensions $$[1\times1]_{NF}=[1\times M]_{NF}[M\times3]_{NF}[3\times1]_{NF}. \tag{19}$$

Note that the subscript NF emphasizes that these matrix relations hold over a discrete grid that spans the significant frequencies. Moreover, while these relations and other resulting operations are most often implemented on a discrete grid of frequencies, these relations can be implemented with analog components over a span of continuous frequencies.

Collapsing the product of the acoustic modes and the TF's in equation 18 as $$G^{mic\leftarrow F}=\Phi R, \tag{20}$$

the acoustic output $S^{mic}$ is most simply expressed as $$S^{mic}=G^{mic\leftarrow F}F, \tag{21}$$

with dimensions $$[1\times1]_{NF}=[1\times3]_{NF}[3\times1]_{NF} \tag{22}$$

and element by element breakdown of $$S^{mic} = [G_V\ G_T\ G_L]\begin{bmatrix}V\\ T\\ L\end{bmatrix}, \tag{23}$$

where the prism modes, $G_\eta$, are defined as the transfer functions between a particular SEF component η(η⊂[V, T, L]), and the measurement $S^{mic}$ at frequency w. The system model of equation 18 could easily require dozens if not hundreds of modes (physical $\Psi_i(r)$ or acoustic $\Phi_i$) and their respective complex amplitudes in order to satisfactorily describe the acoustic output $S^{mic}$. In contrast, the system model $G^{mic\leftarrow F}$ of equation 21 completely defines the acoustic output $S^{mic}$ with only three complex coefficients for each frequency w. In fact, it could be argued that equation 21 flows immediately from the assumed linear response of an SMI to a 3 component SEF F, and that $G^{mic\leftarrow F}$ is the minimum representation required to predict the response due to an arbitrary F. This has the physical interpretation of an SMI acting as parallel bank of three distinct amplifiers, each responsive to a distinct SEF component (see FIG. 4).

It should be noted that $G^{mic\leftarrow F}$ and F are both generally functions of frequency, and that each element by element product represents a filtering operation whose outputs are the respective mode outputs of the re-creation system in FIG. 5. These modal outputs (59, 60, 61) are summed results in the acoustic output $S^{mic}$ 72. This summation is analogous to the form of the re-creation system model in equation 21 and FIG. 5. Forms that efficiently described SMI acoustic characteristics are also effective in resynthesis applications.

The remaining issue is how to determine $G^{mic\leftarrow F}$. Whether we develop an extensive analytic framework of mode shapes $\Phi$ and the respective response matrix R to SEF F, or develop an experimental technique for determining $G^{mic\leftarrow F}$, the resynthesis signal model of equation 9 defines a means to recreate the microphone signal $S^{mic}$ of an arbitrary SMI without the use of a microphone which is an object of the present invention.

b. Using the Microphone Signal $S^{mic}$ as a Calibration Target

In equation 9 we defined a signal model for synthesizing an approximation of the microphone signal, $S^{mic'}$, that uses a multidimensional transfer function $G^{mic'\leftarrow bp}$. A procedure to experimentally determine the specific coefficients comprising $G^{mic'\leftarrow bp}$ is described herein. This is significant because prior art has failed to recognize the underlying signal model and theory that could usefully exploit, let alone reliably determine $G^{mic'\leftarrow bp}$. Moreover, the implementation of equation 9 provides an efficient means for recreating an arbitrarily close approximation to the sound of an SMI.

b1. Microphone

Consider a sequence of microphone measurements (i=1, J) using an SMI in an calibration setup similar to that shown in FIG. 7. Each measurement of the sequence ($_i$) involves exciting the saddle or bridge in an impulsive manner, and recording the scalar microphone measurement that obeys the signal model $$S_i^{mic} = G^{mic\leftarrow F} F_i, \tag{24}$$

and a vector measurement at body points bp that obeys $$S_i^{bp} = G^{bp\leftarrow F} F_i, \tag{25}$$

where the SEF F is assumed undetermined, the quantities $G^{bp}$, $G^{mic}$ are unknown system parameters and $$S_i^{mic}$$

and $$S_i^{bp}$$

are measurements.

The techniques to be described are not extremely sensitive to excitation methodology but there are practical concerns and we have improved our results by damping the strings with light foam and hand pressure, and sharply plucking the strings. Allowing the strings to ring out dramatically lengthens the time window for a significant return and could overrun the capacity of the analog to digital (A/D) board used to capture the signals. This data is initially obtained as timetraces (FIG. 8), but are FFT'd (Fourier Transformed) to yield complex data as a function of frequency (spectral magnitudes are shown in FIG. 9).

We recall equation 9, the system model of a "synthetic system"

$$S^{mic'} = G^{mic\leftarrow bp} S^{bp} \tag{26}$$

with input from body point measurements $S^{bp}$ and output $S^{mic'}$. If both $G^{mic\leftarrow F}$ (equation 24) and $G^{bp\leftarrow F}$ (equation 25) were known, then through the pseudo-inverse operation † (see "Matrix Computations" by Gene H. Golub and Charles F. Van Loan (John Hopkins University Press, 1983)), we could equate Fi in equations 24 and 25 and define the re-creation system (a parallel bank of recreation filters) of equation 26 as $$G^{mic\leftarrow bp} = G^{mic\leftarrow F} G^{bp\leftarrow F\dagger}. \tag{27}$$

Note that for the recreation system $G^{mic\leftarrow bp}$ to preserve the full information content of the SEF F, that $G^{bp\leftarrow F}$ should be rank three (3) (see Golub). The physical interpretation a rank three measurement system $G^{bp\leftarrow F}$, is that there should be at least 3 distinct sensor signals $$S_i^{bp}$$

response to SEF components. In this context, a distinct sensor signal meets the criteriatatsit is unique from other sensor signals and cannot be defined as a linear combination of the other sensors. For example, if the response of one of three sensors could be defined as a linear function of the other two sensors, the measurement system $G^{bp\leftarrow F}$ is deemed rank deficient, which for the purposes of equation 27 is functionally equivalent to having only two sensors. Moreover, since the SEF F is a three component vector, then having more than 3 sensors guarantees that at least one of the sensors provides redundant information and that the measurement system can have at most rank 3.

For the case where the design goal is to recreate the microphone response of an SMI and the ES signals $S^{bp}$ are installed on the same instrument, then neither measurement coloration $G^{bp\dagger}$ nor SMI characteristics as seen by the microphone $G^{mic\leftarrow F}$ need be determined as individual quantities. It is only the product of these terms $G^{mic\leftarrow bp}$ (equation 26) that is needed to recreate the microphone signal $S^{mic}$ from the body point measurements $S^{bp}$ in equation 26.

One may also define an ES measurement system with a known $G^{bp}$ that enables experiments to be performed that can determine the $G^{mic\leftarrow F}$ of a particular SMI. This allows the acoustic response of one instrument (e.g. guitar "A") to be grafted on to the measurement coloration correction $G^{bp\dagger}$ for the ES/SMI combination of a second instrument (e.g. guitar "A")—in effect cloning the sound of the original instrument.

To determine the elements of $G^{mic \leftarrow bp}$, we reorganize the sequence of measurements to conform to the input/output relation of equation 26, and taking each measurement, comprised of scalar microphone $$S_i^{mic}$$

and vector ES measurements $$S_i^q,$$

re-arrange them to define the composite measurement equation $$\overline{S^{mic}} = G^{mic \leftarrow bp} \overline{S^{bp}} \tag{28}$$

with element details $$[S_1^{mic} \ldots S_J^{mic}]_{NF} = \tag{29}$$

$$[G_1 G_2 \ldots G_N]_{NF}^{mic \leftarrow bp} \begin{bmatrix} \begin{bmatrix} S_{1,1}^{\omega p} \\ S_{2,1}^{\omega p} \\ \vdots \\ S_{N,1}^{\omega p} \end{bmatrix} \begin{bmatrix} S_{1,2}^{\omega p} \\ S_{2,2}^{\omega p} \\ \vdots \\ S_{N,2}^{\omega p} \end{bmatrix} \cdots \begin{bmatrix} S_{1,J}^{\omega p} \\ S_{2,J}^{\omega p} \\ \vdots \\ S_{N,J}^{\omega p} \end{bmatrix} \end{bmatrix}_{NF} \tag{30}$$

and dimensions $$[1 \times J]_{NF} = [1 \times N]_{NF} [N \times J]_{NF} \tag{31}$$

where both $\overline{S^{mic}}$ and $\overline{S^{bp}}$ are vectors built up out of distinct measurements and $G^{mic \leftarrow bp}$ is to be determined. Again, we've added the subscript $(\ )_{NF}$ to emphasize that the relations of equations 30 through 31 apply to and are implemented at all significant frequencies.

By maintaining the same relative microphone/SMI positions across experiments, the system characterization $G^{mic \leftarrow bp}$ remains constant with respect to the sequence index i. While playing technique provides some inherent variation in the SEF traces, we deliberately vary the pluck and strike directions across the sequence; Variations in SEF, Fi(w), across different experiments i then guarantee differing columns of $\overline{S^{bp}}$ in equation 30. This variation of excitation, along with the required condition of a rank three (3) $G^{bp \leftarrow F}$ described earlier, guarantees a rank three $\overline{S^{bp}}$ for each significant frequency. Hence, the term $\overline{S^{bp}}$ is readily inverted in the case of three measurements and "pseudo-inversed" in the under/over-determined case (# of experiments ≠3) (see Golub), to solve equation 28 for $$\hat{G}^{mic \leftarrow bp} = \overline{S^{mic}} \overline{S^{bp}}^{\dagger}. \tag{32}$$

Where $\hat{(\ )}$ represents the estimate of the object inside of ( ) and in this case, the algorithm just described yields a $$\hat{G}^{mic \leftarrow bp} \text{ and } G^{mic' \leftarrow F} = \hat{G}^{mic \leftarrow bp} \tag{33}$$

is the requisite re-creation system (filter bank) for the microphone signal based on ES data input $S^{bp}$ per equation 9. Contingent on taking at least three measurements (for a three component $S^{bp}$ measurement), and varying the excitation across measurements, the measurement scenario and the properties of the singular value decomposition (Golub) ensures that the individual elements of $G^{mic' \leftarrow bp}$ are determined along with the resulting recreation system specification. Moreover, through the singular values of the pseudo-inverse, the SVD operation provides an intrinsic measure of the invertability of $\overline{S^{bp}}$ in equation 32 and a measure of the quality of the experimental data.

b2. Calibration Procedure

We now define the transfer function $G^{2 \leftarrow 1} S^1$ as the relation between two distinct measurements, $S^1$ (source) and $S^2$ (re-creation target), that solves $$S^2 = G^{2 \leftarrow 1} S^1. \tag{34}$$

The procedure to define the elements of $G^{2 \leftarrow 1}$ can be illustrated for the specific case of $G^{mic' \leftarrow bp}$ as follows:

With prerequisites that:

1. the geometry of the acoustic experiment is fixed as in FIG. 7, including microphone placement, ES placement, SMI mounting and position.
2. recording equipment is set to record microphone signal and all ES sensor signals, preferably triggered. FIG. 7 shows this as four input lines to an ADC card mounted in a PC.
3. The recording system can store the results of at least three measurements as defined above, then a measurement is performed a plurality of times as follows:
   1. Pluck the damped strings of an SMI or impulsively strike points practicably close to the witness point wp with varied direction.
   2. Record the time traces $$[s_1^{bp}(t) s_1^{bp}(t) s_3^{bp}(t) s_i^{mic}(t)]$$

signal sets (100, 102, 104, 106) for all pertinent channels. An example of the four time traces are shown in FIG. 8, in a "stacked" format.

After the data has been stored, the processing steps are:

1. Using a time to frequency transform such as an FFT, convert the timetrace data (FIG. 8) to frequency data in order to form the data signal sets $$[S_1^{bp}(w) S_2^{bp}(w) S_3^{bp}(w) S_i^{mic}(w)]$$

(110, 112, 114, 116) in FIG. 9).

2. For each frequency,
   (a) re-arrange DATA to form composite measurement as defined in equation 28.
   (b) perform a pseudo-inverse of the form of equation 32, and store the results in another array $G^{mic' \leftarrow bp}$.
3. The three individual components $G^{mic' \leftarrow bp}$ are shown as (45, 46, 47,) in FIG. 10.

b3. Calibration of a Multiple Sensor Output

Above we defined a calibration procedure for obtaining the transfer function $G^{2 \leftarrow 1} S^1$ as the relation between the signals $S^1$ and $S^2$. It should be emphasized that the target re-creation need not be a scalar signal as a single microphone would be. The mathematics of the SVD inversion readily accommodate a transfer function re-creation for multiple signals. Recalling equation 30 and equation 34, all that is required is an expansion of the matrix notation as follows (again all quantities are implicit functions of frequency):

With the arbitrary re-creation "target" $S^2$ defined as a vector (ie a set of microphone signals)

$$S^2=[S^{m1} \ldots S^{mQ}] \tag{35}$$

and $S^1$ being a vector of source signals, then $$\overline{S^2}=G^{2\leftarrow 1}\overline{S^1} \tag{36}$$

Furthermore, with $S_{i,j}^{bp}$ defined as the $i^{th}$ element the original vector source $S^1$ measured at the $j^{th}$ experiment (cut), and the element $_{gQ,N}$ of $G^{2\leftarrow 1}$ being the requisite transfer function between the $n^{th}$ element of $S^1$ and the $q^{th}$ element of $S^2$, then equation 36 breaks out as $$\begin{bmatrix} S_1^{m1} & S_J^{m1} \\ \vdots & \vdots \\ S_1^{mQ} & S_J^{mQ}{}_1 \end{bmatrix} = \begin{bmatrix} g_{1,1} & & g_{1,N} \\ \vdots & \cdots & \vdots \\ g_{Q,N} & & g_{Q,N} \end{bmatrix} \left[ \begin{bmatrix} S_{1,1}^{bp} \\ \\ S_{N,1}^{bp} \end{bmatrix} \vdots\vdots \begin{bmatrix} S_{1,J}^{bp} \\ \\ S_{N,J}^{bp} \end{bmatrix} \right] \tag{37}$$

with dimensions $$[Q_{synths} \times J_{cuts}]_{NF}=[Q_{synths} \times N_{elements}]_{NF}[N_{elements} \times J_{cuts}]_{NF} \tag{38}$$

The invertability of Equation 37 is subject to the same conditions as equation 32, and as defined in this section, while the final implementation can be view as a set of Q re-creation system (FIG. 5), one for each row of $G^{2\leftarrow 1}$.

Some applications for this multiple output calibration scenario include the re-creation of binaural reception of SMI using two microphones and an embedded suite of sensors for the body of an acoustic guitar.

b4. Additional Configurations

It was shown above in this section, that the subspace mathematics represented by the pseudo inverse operation of equation 32 can accomodate calibration setups with over-determined data and/or system models with more than three signals as the "input" to the system and a plurality of microphones as the output. Moreover, the mathematics provides the mechanism to introduce a post processing array T to the raw data array $\overline{S^{bp}}$ $$\overline{S'^{bp}}=T\overline{S^{bp}}. \tag{39}$$

As shown below, using such a weighting vector T, one can mask specific sensor signals $$S_i^{bp},$$

and consider systems where only a subset of the full sensor complement is available, but where an approximation to the full sound re-creation $S^{mic'}$ (equation 26) would be an acceptable substitute. This could be the case in some SMI's which are substantially unresponsive to a specific SEF component. Another example would be an SMI where certain modes of vibration are significantly attenuated. A recreation system could adequately re-create the transfer functions of the SMI with a reduced number of effective degrees of freedom by employing less than the full complement of three sensors required in the general case.

Other configurations could employ a full sensor suite for a calibration measurement according to equation 32 but a final commercial product could use a subset of the sensors of a full system specification. This would be accomplished for example by setting the $i^{th}$ term of $G^{mic'\leftarrow bp}$ in equation 40 to zero, effectively ignoring the unwanted signal $$S_i^{bp}.$$

b5. Resynthesis Procedure

The re-creation system of equation 26 (restated below without a sequence index) is then readily performed in the frequency domain as $$S^{mic'}=G^{mic'\leftarrow bp}S^{bp} \tag{40}$$

or the filtering can be performed in the time domain, $$S^{mic'}(t) = \sum_{Nmodes} g^{mic'\leftarrow bp}(t) \otimes S^{bp}(t) \tag{41}$$

where ⊗ represents a convolution, and g and s are the inverse Fourier transforms of G and S. Each PRISM mode of FIG. 5 is a linear transfer function defined in the frequency domain by the respective elements of $G^{mic\leftarrow wp}$.

The filtering operations called for in equation 41 are implemented in the re-creation bank of FIG. 5 as either FIR (finite impulse response) or IIR (infinite impulse response). It is also possible to directly implement equation 40 in the frequency domain but this is equivalent to an FIR filtering operation.

Given the constraints of data presentation on paper, time domain plots are very good at highlighting small differences in signals; Matching time domain "squiggles" require relatively high correlation of phase and amplitude values that are not readily apparent in the frequency domain. In FIG. 11 we show a comparison between the original microphone signal and the resynthesized signal generated by a three sensor PRISM system as described by equation 41. The comparison of the "Full FIR resynthesis" (132 in FIG. 11) with the original microphone signal (130 in FIG. 11) displays very high levels of fidelity that are corroborated by playing/listening tests.

c. Improved Measurement Means with a Known $G^{wp}$ (Prism Mount)

Another embodiment of the present invention relates one set of vector measurements (such as found at or near the witness point) to another set of body point measurements. The primary object of a witness point measurement $S^{wp}$, (as opposed to a body point measurement $S^{bp}$), is to measure the SEF F with as little coloration as possible. As described above, a microphone signal $S^{mic'}$ could be recreated from a set of body point measurements $S^{bp}$ with the system model $G^{mic'\leftarrow bp}$ of equation 40, $$G^{mic'\leftarrow bp} = G^{mic}\hat{}G^{bp\dagger}, \tag{42}$$

even though the individual factors $G^{bp\dagger}$ and $G^{mic}$ were undetermined. This works fine when the $G^{mic}$ (SMI sound generation) and $G^{bp}$ (ES measurement colorations) are from the same instrument in the same measurement scenario. However, an understanding of $G^{mic}$ and $G^{bp}$ as individual components provides the ability to overlay the SMI acoustic response characterization $G^{mic\leftarrow F'}$ onto the correction for ES coloration $G^{bp'\dagger}$ of another SMI. This greatly expands the flexibility and possible applications of the present invention.

Through careful design we can define an ES measurement with a known $G^{wp}$ relation that serves as a useful proxy for $G^{bp}$. which provides a common reference across different SMIs. This common reference is a prerequisite to grafting the SMI characteristics of one instrument $G^{mic\leftarrow F'}$ onto a re-creation system operating with body point measurements $S^{bp}$ from another instrument. FIG. 12 shows a typical measurement geometry (a "Prism mount") that can provide a consistent measurement relation $G^{wp}$ between the SEF F and a set of force measurements $$S^{wp}=G^{wp}F. \tag{43}$$

Analogous to an optical prism, the PRISM mount provides the ability to decompose the components of SEF F into its constitutive components. With a known rank three measurement relation $G^{wp}$, we can invert this measurement model to yield an estimate of the forces $$F'=G^{wp\dagger}S^{wp}. \tag{44}$$

We can then use a Prism mount (modeled with a known $G^{wp}$) to define relations between pairs of SMI's (e.g. an acoustic and an electric guitar). We set up a new "stacked" measurement $$\overline{S^{mic}}=G^{mic\leftarrow F'}\overline{F'}, \tag{45}$$

and analogous to equation 32, determine $G^{mic\leftarrow F'}$ as $$\hat{G}^{mic\leftarrow F'}=\overline{S^{mic}}^{\dagger}\overline{F'}. \tag{46}$$

Then the acoustic response characterization of the first SMI $$\hat{G}^{mic\leftarrow F'}$$

can be "grafted" onto the correction for ES measurement coloration of a second SMI $G^{wp'\dagger}$ (e.g. an electric guitar), to yield a new system characterization $$G^{mic''}=\hat{G}^{mic\leftarrow F'}G^{wp'\dagger}. \tag{47}$$

This approach clones the sound characteristics of the original musical instrument $G^{mic}$ onto the measurement coloration of another instrument $G^{wp'\dagger}$ which could employ an entirely different measurement technique.

The experimental and resynthesis procedures defined above (b2.) used the microphone signal as the truth point that the other sensors are calibrated to. Calibrating to the generic signal $S^{q}$, we could also specify a that the final "truth signal" be derived from linear operations performed on the mic signal $S^{mic}$ or the result of a large computer simulation that determines specific realizations of equation 3.

In fact, relations between one set of N-measurements in and around the body and any other set of measurements can be defined and exploited by the procedures introduced herein.

d. SEF Component Nulling

When the measurement system modeled by $G^{wp}$ has the full rank of three, then the witness point measurement defined by $$S^{wp}=G^{wp}F \tag{48}$$

will be responsive to all components of the SEF F. However, there are several cases where removing a specific component of SEF is considered advantageous. Consider an additional post processing matrix T applied to the witness point measurement $S^{wp}$ as $$S^{NULL}=TS^{wp} \tag{49}$$

$$=TG^{wp}F \tag{50}$$

$$=G^{(NULL\leftarrow F)}F \tag{51}$$

In order for $S^{NULL}$ to be devoid of components due to a particular SEF component (e.g. longitudinal), we define the composite system $G^{(NULL\leftarrow F)}$ to be unresponsive to a unwanted SEF component by simply setting the respective element of $G^{(NULL\leftarrow F)}$ to zero and solve for T. For example, to ignore the longitudinal component of F we set $$G^{(NULL\leftarrow F)}=[1\ 1\ 0] \tag{52}$$

and since $$TG^{wp}=G^{(NULL\leftarrow F)} \tag{53}$$

then $$T=G^{(NULL\leftarrow F)}G^{wp\dagger} \tag{54}$$

$$T=[1\quad 1\quad 0]G^{wp\dagger}. \tag{55}$$

Through equation 55, $G^{(NULL\leftarrow F)}$ can set an arbitrary weighting of SEF components F and define the T processing matrix that affects this result in equation 50.

Scherer teaches the use of reversing the polarity of one of two coplanar sensors and summing the pair to affect a null in the response to vertical forces. For a two element sensor that ignores the longitudinal forces, the measurement equation becomes, $$G^{wp''}=\begin{bmatrix}1 & -1 & 0\\ 1 & 1 & 0\end{bmatrix} \tag{56}$$

and for the system model $$S^{Scherer}=TS^{wp''} \tag{57}$$

$$=TG^{wp''}F \tag{58}$$

$$=G^{(Scherer\leftarrow F)}F, \tag{59}$$

Scherer's specification of a sensor that is uniquely responsive to horizontal forces is alternately specified as $$G^{(Scherer\leftarrow F)}=[0\quad 1\quad 0]. \tag{60}$$

Equating equations 58 and 59, the $T^{Scherer}$ that solves $$T^{Scherer}G^{wp''}=G^{(Scherer\leftarrow F)} \tag{61}$$

is $$T^{Scherer}=G^{(Scherer\leftarrow F)}G^{wp''\dagger} \tag{62}$$

$$=[0\quad 1\quad 0][1\quad 1\quad 0]^{\dagger} \tag{63}$$

$$=[-0.5\quad 0.5], \tag{64}$$

or restating, $T^{Scherer}$ takes the difference between the first and second sensor. Clearly, we have taken a less direct route than Scherer's notion of subtracting one signal from another. However, the advantage to the approach defined in equation 55 is that it can readily handle variations in sensor orientation, non-ideal transducers or configurations where a longitudinal component cannot be ignored.

e. Known $G^{wp}$

A methodology for determining $G^{wp}$, the force to measurement transfer function is summarized as follows. The following is an approximate, linearized analysis of a measurement system with a known $G^{wp}$, where we assume small deflections from nominal positions. Small deflections, along with relatively low frequencies allow us to ignore inertial terms and set the sum of forces and moments acting on the object to zero—more involved analysis can address this simplification.

Referring to FIG. 12, we assume that the motions of the mount 82 can be predominantly described by the position (translation and rotation) vector $$\Theta = \begin{bmatrix} \Delta_z \\ \Delta_{xx} \\ \Delta_{yy} \end{bmatrix} \tag{65}$$

where $\Delta_z$ is the vertical translation, $\Delta_{xx}$ is the rotation about the "x-axis" (roll mode), and $\Delta_{yy}$ is the rotation about the "y-axis" (pitch mode). We assume that the sensors A, B, C (240, 242, 244) are predominantly responsive to compression.

The physical model can be readily extended to account for all second order effects such as slight shear that sensors A, B, C (240, 242, 244) might experience. Then the deflection vector $$\Gamma = \begin{bmatrix} \Delta_A \\ \Delta_B \\ \Delta_C \\ \Delta_X \\ \Delta_Y \\ \Delta_Z \end{bmatrix} \tag{66}$$

with $\Delta_A$, $\Delta_B$, $\Delta_C$ the vertical deflection of sensors A, B, C (240, 242, 244) respectively, and related to the translation vector $\Theta$ $$\begin{bmatrix} \Delta_A \\ \Delta_B \\ \Delta_C \\ \Delta_X \\ \Delta_Y \\ \Delta_Z \end{bmatrix} = \begin{bmatrix} 1 & A_x & A_y \\ 1 & B_x & B_y \\ 1 & C_x & C_y \\ 0 & 0 & T_z \\ 0 & T_z & 0 \\ 1 & 0 & 0 \end{bmatrix} * \begin{bmatrix} \Delta_z \\ \Delta_{xx} \\ \Delta_{yy} \end{bmatrix} \tag{67}$$

or more compactly $$\Gamma = \Lambda\Theta \tag{68}$$

where $\Lambda$ contains moment arms specific to the geometry, T is the position of the apex 248, A, B, C (240, 242, 244), are the position of the vertices and $(\ )_{vi}$ is the vector component in the $v_i^{th}$ direction. Now, we limit the force vector (force and moments) to the same three significant elements that comprise the translation vector, with $$\Omega = \begin{bmatrix} F_z \\ M_{xx} \\ M_{yy} \end{bmatrix} \tag{69}$$

Then the forces on the mount due to the sensors (240, 242, 244) and the string tailpiece portion 152 are a generalized spring described by the product of stiffness and deflections as $$\Omega = K\Gamma \tag{70}$$

where $$K = \begin{bmatrix} k_A & k_B & k_C & 0 & 0 & KZ \\ k_A A_y & k_B B_y & k_C C_y & 0 & 0 & KZ * T_y \\ k_A A_x & k_B B_y & k_C C_x & KX * T_z & 0 & KZ * T_x \end{bmatrix}, \tag{71}$$

with the horizontal and vertical spring components of the string tailpiece portion 152 $KZ = k_s \sin(O_b)$, $KX = k_s \cos(O_b)$ and break angle $O_b$.

Then the forces and moments due to the deflections are $$\Omega = K\Gamma \tag{72}$$

$$= K\Lambda\Theta \tag{73}$$

The excitation $\Pi$ applied at the witness point 78 has three force components $$\Pi = \begin{bmatrix} Q_x \\ Q_y \\ Q_z \end{bmatrix}. \tag{74}$$

These force components resolve through the "moment arm"

$$\Upsilon = \begin{bmatrix} 0 & 0 & 1 \\ 0 & T_z & T_y \\ T_z & 0 & T_x \end{bmatrix} \tag{75}$$

to the excitation forces and moments $$\Omega' = \Upsilon\Pi. \tag{76}$$

Now, we assume that the mass and accelerations are small compared to the forces applied, and we can equation the mount reactions $\Omega$ to the excitation forces and moments as $\Omega'$ as $$K\Gamma = \Upsilon\Pi. \tag{77}$$

Then the relation between mount deflections $\Gamma$ and string force applied at the witness point $\Pi$ is defined as $$\Gamma = K^{\dagger}\Upsilon\Pi. \tag{78}$$

where † is again the pseudo-inverse operation. A new measurement matrix that relates deflection $\Gamma$ to voltage V, $$V = \begin{bmatrix} v_a & 0 & 0 & 0 & 0 & 0 \\ 0 & v_b & 0 & 0 & 0 & 0 \\ 0 & 0 & v_c & 0 & 0 & 0 \\ 0 & 0 & 0 & 0 & 0 & 0 \\ 0 & 0 & 0 & 0 & 0 & 0 \\ 0 & 0 & 0 & 0 & 0 & 0 \end{bmatrix} \begin{bmatrix} \Delta_A \\ \Delta_B \\ \Delta_C \\ \Delta_X \\ \Delta_Y \\ \Delta_Z \end{bmatrix} \tag{79}$$

$$V = V\Gamma \tag{80}$$

$$= VK^{\dagger}\Upsilon\Pi. \tag{81}$$

which relates forces imposed at the witness point to output voltage vector V, where we've assumed a simplified compressional response through $v_{a,b,c}$, but the deflection matrix $\Gamma$ and response matrix V could be extended with additional terms.

Alternatively, a careful experiment could be performed applying an AC force vector directly at the witness point in the x, y, z directions as separate measurements and measuring the voltage output (magnitude and phase) of the sensors.

It is obvious to those of ordinary skill in the art of the present invention, that the proper specification of the input $\overline{S^{bp}}$ and output $\overline{S^{mic}}$ signals, defines both the re-creation filters $G^{mic' \leftarrow bp}(w)$ through equation 32, and and a signal processing system comprised of the summation of these re-creation filters that can accomodate a broad range of functional characteristics.

It is also obvious that an arbitrary re-creation filter can be specified and implemented a based on combinations of linear operations on the output $\overline{S^{mic}}$ or through the specification of characteristic relations among the responses of respective SEF components (as in equation 55). The theoretical framework for signal processing and sensor design of the present invention preserves the full rank information of the strings' vibrations and affords greater flexibility in the measurement and processing of stringed acoustic instrument signals.

While there have been shown and described and pointed fundamental novel features of the invention as applied to embodiments thereof, it will be understood that various omissions and substitutions and changes in the form and details of the invention, as herein disclosed, may be made by those skilled in the art without departing from the spirit of the invention. It is expressly intended that all combinations of those elements and/or method steps which perform substantially the same function in substantially the same way to achieve the same results are within the scope of the invention. It is the intention, therefore to be limited only as indicated by the scope of the claims appended hereto.

What is claimed is:

1. A signal processing system comprising:

a first stringed musical instrument;

a plurality of sensors mounted on said first stringed musical instrument, each of said sensors responsive to at least one of force, displacement, velocity or acceleration and indicative of the vibrational response at a body point on said musical instrument;

a set of body points forming a body point vector;

a set of vibrational responses at said set of body points forming a body point response vector;

a set of signals from said sensors forming a sensor signal vector, said sensor signal vector being equivalent to a full rank transformation of said body point response vector;

at least one signal processor having a plurality of re-creation filters for processing and transforming said sensor signal vector into a transformed signal vector, wherein said transformed signal vector is equivalent to a full rank transformation of the body point response vector;

a resynthesized output signal formed by said re-creation filters and corresponding to said transformed signal vector.

2. The signal processing system of claim 1, wherein said plurality of sensors are responsive to at least one of force, displacement, velocity or acceleration and indicative of the vibrational response provided by a plurality of strings generally around a bridge assembly of said first stringed musical instrument.

3. The signal processing system of claim 1, wherein said plurality of sensors are responsive to at least one of force, displacement, velocity or acceleration and indicative of the vibrational response provided by a plurality of strings generally around a bridge and saddle assembly of said first stringed musical instrument.

4. The signal processing system of claim 1, wherein at least one of said resynthesized output signals is a microphone output signal.

5. The signal processing system of claim 4, wherein said resynthesized output signal formed by said re-creation filters comprises a summation of vector components of at least one transformed signal vector.

6. The signal processing system of claim 1, wherein at least one of said plurality of re-creation filters transforms said sensor signal vector having acoustic characteristics of said first stringed musical instrument to a resynthesized output signal having acoustic characteristics of another stringed musical instrument that differ from the acoustic characteristics of said first stringed musical instrument.

7. The signal processing system of claim 6, wherein said resynthesized output signal possesses acoustic characteristics of a known stringed musical instrument.

8. The signal processing system of claim 6, wherein said resynthesized output signal possesses acoustic characteristics of a theoretical stringed musical instrument.

9. The signal processing system of claim 6, wherein said resynthesized output signal is a microphone output signal.

10. The signal processing system of claim 1, wherein at least one of said plurality of re-creation filters implements a predetermined ratio of a response amplification to various signal components of said sensor signal vector.

11. The signal processing system of claim 1, wherein the re-creation filters produce a plurality of resynthesized output signals that comprise at least two distinct groups of output signals to create binaural output signals corresponding to outputs of said stringed musical instrument at different positions.

12. The signal processing system of claim 1, wherein at least one of said plurality of re-creation filters cascades correcting functions for sensor characteristics and applies an acoustic transfer function of another stringed musical instrument.

13. The signal processing system of claim 1, wherein said plurality of sensors is at least three sensors.

14. A signal processing system comprising:

a first stringed musical instrument;

a plurality of sensors mounted on said first stringed musical instrument, each of said sensors responsive to at least one of force, displacement, velocity or acceleration and indicative of the vibrational response at a body point on said musical instrument;

a set of body points forming a body point vector;

a set of vibrational responses at said set of body points forming a body point response vector;

a set of signals from said sensors forming a sensor signal vector, said sensor signal vector being equivalent to at least rank-2 transformation of said body point response vector;

at least one signal processor having a plurality of re-creation filters for processing and transforming said sensor signal vector into a transformed signal vector, wherein said transformed signal vector is equivalent to at least rank-2 transformation of the body point response vector;

a resynthesized output signal formed by said re-creation filters and corresponding to said transformed signal vector.

15. The signal processing system of claim 14, wherein said plurality of sensors are responsive to at least one of force, displacement, velocity or acceleration and indicative of the vibrational response provided by a plurality of strings generally around a bridge assembly of said first stringed musical instrument.

16. The signal processing system of claim 14, wherein said plurality of sensors are responsive to at least one of force, displacement, velocity or acceleration and indicative of the vibrational response provided by a plurality of strings generally around a bridge and saddle assembly of said first stringed musical instrument.

17. The signal processing system of claim 14, wherein at least one of said resynthesized output signals is a microphone output signal.

18. The signal processing system of claim 14, wherein said resynthesized output signal formed by said re-creation filters comprises a summation of vector components of at least one transformed signal vector.

19. The signal processing system of claim 14, wherein at least one of said plurality of re-creation filters transforms said sensor signal vector having acoustic characteristics of said first stringed musical instrument to a resynthesized output signal having acoustic characteristics of another stringed musical instrument that differ from the acoustic characteristics of said first stringed musical instrument.

20. The signal processing system of claim 19, wherein said resynthesized output signal possesses acoustic characteristics of a known stringed musical instrument.

21. The signal processing system of claim 19, wherein said resynthesized output signal possesses acoustic characteristics of a theoretical stringed musical instrument.

22. The signal processing system of claim 19, wherein said resynthesized output signal is a microphone output signal.

23. The signal processing system of claim 14, wherein at least one of said plurality of re-creation filters implements a predetermined ratio of a response amplification to various signal components of said sensor signal vector.

24. The signal processing system of claim 14, wherein the re-creation filters produce a plurality of resynthesized output signals that comprise at least two distinct groups of output signals to create binaural output signals corresponding to outputs of said stringed musical instrument at different positions.

25. The signal processing system of claim 14, wherein at least one of said plurality of re-creation filters cascades correcting functions for sensor characteristics and applies an acoustic transfer function of another stringed musical instrument.

26. The signal processing system of claim 14, wherein said plurality of sensors is at least two sensors.

27. A signal processing method comprising the steps of:

sensing and measuring through a plurality of sensors mounted on a first stringed musical instrument at least one vector measurement of force, displacement, velocity or acceleration, indicative of the vibrational response at a body point on said musical instrument;

forming a body point vector based on a set of body points;

forming a body point response vector based on a set of vibrational responses at said set of body points;

forming a sensor signal vector from said set of signals the sensors, wherein said sensor signal vector is equivalent to a full rank transformation of said body point response vector;

processing and transforming said sensor signal vector by a plurality of re-creation filters in at least one signal processor into a transformed signal vector, wherein said transformed signal vector is equivalent to a full rank transformation of the body point response vector; and producing a resynthesized output signal formed by said re-creation filters and corresponding to said transformed signal vector.

28. The signal processing method of claim 27, wherein said step of sensing by said plurality of sensors is responsive to at least one of force, displacement, velocity or acceleration and indicative of the vibrational response provided by a plurality of strings generally around a bridge assembly of said first stringed musical instrument.

29. The signal processing method of claim 27, wherein said step of sensing by said plurality of sensors is responsive to at least one of force, displacement, velocity or acceleration and indicative of the vibrational response provided by a plurality of strings generally around a bridge and saddle assembly of said first stringed musical instrument.

30. The signal processing method of claim 27, wherein said step of producing the resynthesized output signal comprises producing a microphone output signal.

31. The signal processing method of claim 30, wherein said step of producing the resynthesized output signal by said re-creation filters comprises a summation of vector components of at least one transformed signal vector.

32. The signal processing method of claim 27, wherein in said step of processing and transforming said sensor signal vector at least one of said plurality of re-creation filters transforms said sensor signal vector having acoustic characteristics of said first stringed musical instrument to a resynthesized output signal having acoustic characteristics of another stringed musical instrument that differ from the acoustic characteristics of said first stringed musical instrument.

33. The signal processing method of claim 32, wherein said resynthesized output signal possesses acoustic characteristics of a known stringed musical instrument.

34. The signal processing method of claim 32, wherein said resynthesized output signal possesses acoustic characteristics of a theoretical stringed musical instrument.

35. The signal processing method of claim 32, wherein said resynthesized output signal is a microphone output signal.

36. The signal processing method of claim 27, wherein at least one of said plurality of re-creation filters implements a predetermined ratio of a response amplification to various signal components of said sensor signal vector.

37. The signal processing method of claim 27, further comprising a step of producing a plurality of resynthesized output signals by said re-creation filters, wherein said resynthesized output signals comprise at least two distinct groups of output signals and create binaural output signals corresponding to outputs of said stringed musical instrument at different positions.

38. The signal processing method of claim 27, wherein said step of processing and transforming said sensor signal vector comprises cascading correcting functions for sensor characteristics and applying an acoustic transfer function of another stringed musical instrument.

39. The signal processing method of claim 27, wherein said step of sensing is performed by at least three sensors.

* * * * *